US011800918B2

(12) United States Patent
Lei et al.

(10) Patent No.: US 11,800,918 B2
(45) Date of Patent: Oct. 31, 2023

(54) BLOW DRYER

(71) Applicant: SHENZHEN CARKU TECHNOLOGY CO., LIMITED, Guangdong (CN)

(72) Inventors: Yun Lei, Guangdong (CN); Chuwei Liu, Guangdong (CN); Yubin Zhang, Guangdong (CN)

(73) Assignee: SHENZHEN CARKU TECHNOLOGY CO., LIMITED, Shenzhen (CN)

( * ) Notice: Subject to any disclaimer, the term of this patent is extended or adjusted under 35 U.S.C. 154(b) by 0 days.

(21) Appl. No.: 17/842,398

(22) Filed: Jun. 16, 2022

(65) Prior Publication Data

US 2022/0304445 A1 Sep. 29, 2022

Related U.S. Application Data

(63) Continuation of application No. 17/318,694, filed on May 12, 2021, now Pat. No. 11,388,973.

(30) Foreign Application Priority Data

Nov. 10, 2020 (CN) ..... 202011252233.2
Nov. 10, 2020 (CN) ..... 202022592963.9

(51) Int. Cl.
*A45D 20/12* (2006.01)

(52) U.S. Cl.
CPC ..... *A45D 20/12* (2013.01); *A45D 2020/126* (2013.01)

(58) Field of Classification Search
CPC ..... A45D 20/12; A45D 2020/126; A45D 2020/128; A45D 20/122
See application file for complete search history.

(56) References Cited

U.S. PATENT DOCUMENTS 4,287,673 A * 9/1981 Wolter ..... A45D 20/122 239/524
6,966,125 B2 * 11/2005 Rago ..... A45D 20/12 34/283

(Continued)

FOREIGN PATENT DOCUMENTS

CN 206197319 U 5/2017
CN 108851463 A 11/2018

(Continued)

OTHER PUBLICATIONS

The Extended European Search Report issued in corresponding EP Application No. EP21175464.3, dated Nov. 18, 2021.

(Continued)

*Primary Examiner* — Jessica Yuen
(74) *Attorney, Agent, or Firm* — HAUPTMAN HAM, LLP

(57) ABSTRACT

The present disclosure provides a blow dryer. The blow dryer includes an air duct and a handle coupled to the air duct. The air duct arranges an air outlet channel and an air outlet in air communication with the air outlet channel. The air duct is provided with an air guiding element at a front end of the air outlet channel. The air guiding element is configured to guide airflow in the air outlet channel to an inside wall of the air outlet channel, so that the airflow is concentrated and discharged from the air duct through the air outlet, thus increasing the strength of the wind pressure provided by the blow dryer.

18 Claims, 20 Drawing Sheets

(56) References Cited

U.S. PATENT DOCUMENTS

| | | | | |
|---|---|---|---|---|
| 9,596,916 | B2 * | 3/2017 | Moloney | A45D 20/12 |
| 9,930,950 | B1 | 4/2018 | Cage | |
| 10,608,297 | B2 | 3/2020 | Goldman et al. | |
| 2003/0079366 | A1 * | 5/2003 | Chang | A45D 20/122 34/96 |
| 2006/0227491 | A1 | 10/2006 | Rosati et al. | |
| 2017/0112258 | A1 * | 4/2017 | Blanc | H02K 5/24 |
| 2019/0142132 | A1 * | 5/2019 | Nelson | H02J 7/0016 34/96 |
| 2020/0008552 | A1 | 1/2020 | Thein | |

FOREIGN PATENT DOCUMENTS

| | | | |
|---|---|---|---|
| CN | 209732890 | U | 12/2019 |
| CN | 110638183 | A | 1/2020 |
| CN | 110664084 | A | 1/2020 |
| CN | 112821671 | A | 5/2021 |
| EP | 2255692 | A1 | 12/2010 |
| GB | 2527028 | A | 12/2015 |
| KR | 20190117859 | A | 10/2019 |
| KR | 20200033153 | A | 3/2020 |
| KR | 102170309 | B1 | 10/2020 |
| WO | 2017068322 | A1 | 4/2017 |
| WO | 2020136229 | A1 | 7/2020 |

OTHER PUBLICATIONS

International Search Report issued in corresponding International Application No. PCT/CN2021/092379, dated Jun. 30, 2021.
The First Office Action issued in corresponding AU Application No. AU2021203252, dated May 12, 2022.

* cited by examiner

BLOW DRYER

CROSS-REFERENCE TO RELATED APPLICATION(S)

This application is a continuation of U.S. patent application Ser. No. 17/318,694, filed on May 12, 2021, which claims priority to and the benefit of Chinese Patent Application No. 202022592963.9 and 202011252233.2, filed on Nov. 10, 2020, the entire disclosure of which are hereby incorporated by reference in their entireties.

TECHNICAL FIELD

The present disclosure relates to the technology field of blow dryers, and in particular to a blow dryer.

BACKGROUND

In the traditional wired blow dryers currently on the market, in daily use, a power cable of the wired blow dryer is easy to be wrapped around a user's arm or other objects, which is inconvenient to use. In addition, the traditional wired blow dryers include an air duct provided with an air outlet channel, and flow directions of internal airflow are substantially parallel to a central axis of the air outlet channel, thus decreasing the strength of the wind pressure.

SUMMARY

The purpose of the present disclosure is to provide a wireless blow, which increases the strength of the wind pressure.

In order to solve the above technical problems, the present disclosure provides a blow dryer. The blow dryer includes an air duct and a handle coupled to the air duct. The air duct arranges an air outlet channel and an air outlet in air communication with the air outlet channel. The air duct is provided with an air guiding element at a front end of the air outlet channel. The air guiding element is configured to guide airflow in the air outlet channel to an inside wall of the air outlet channel, so that the airflow is concentrated and discharged from the air duct through the air outlet.

Another aspect of the present disclosure provides a wireless hair dryer. The blow dryer includes an air duct and a handle coupled to the air duct. The air duct arranges an air outlet channel and an air outlet in air communication with the air outlet channel. The air duct is provided with an air guiding element at a front end of the air outlet channel. The air guiding element is configured to guide airflow in the air outlet channel to an inside wall of the air outlet channel, so that the airflow is concentrated and discharged from the air duct through the air outlet, thus changing flow directions of internal airflow by the air guiding element, and thereby increasing the strength of the wind pressure provided by the blow dryer.

BRIEF DESCRIPTION OF THE DRAWINGS

In order to illustrate the technical solutions of the embodiments of the present disclosure more clearly, the accompanying drawings that need to be used in the embodiments will be briefly introduced below. Obviously, the accompanying drawings described below are merely some embodiments of the present disclosure. For those skilled in the art, other drawings can also be obtained based on these accompanying drawings without paying creative work.

DETAILED DESCRIPTION

The technical solutions in the embodiments of the present application will be described clearly and completely in combination with the accompanying drawings in the embodiments of the present application. Obviously, the described embodiments are only part of the embodiments of the present application, rather than all the embodiments. Based on the embodiments in the present disclosure, all other embodiments obtained by those of ordinary skill in the art without making creative work shall fall within the protection scope of the present disclosure.

In the description of the embodiments of the present disclosure, it should be understood that the orientation or positional relationship indicated by the term "thickness" is based on the orientation or positional relationship shown in the accompanying drawings, and is only for the convenience of describing the present disclosure and simplifying the description, rather than implying that the device or element referred to must have a specific orientation, be constructed and operated in a specific orientation, and therefore cannot be understood as a limitation of the present disclosure.

Figure 8:
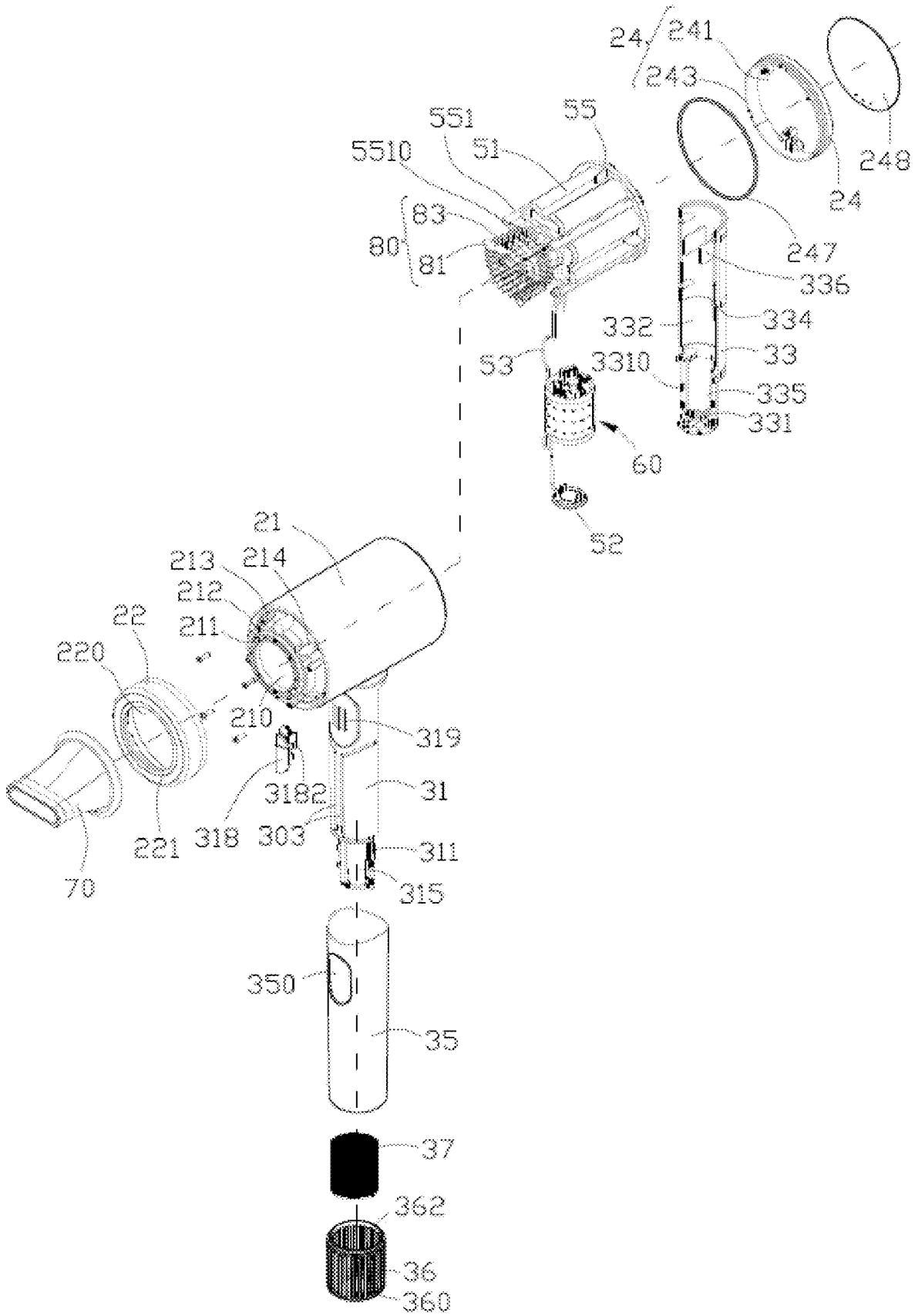
FIG. 8 is a further exploded schematic diagram of the three-dimensional structure of the wireless blow dryer illustrated in FIG. 2.
Figure 9:
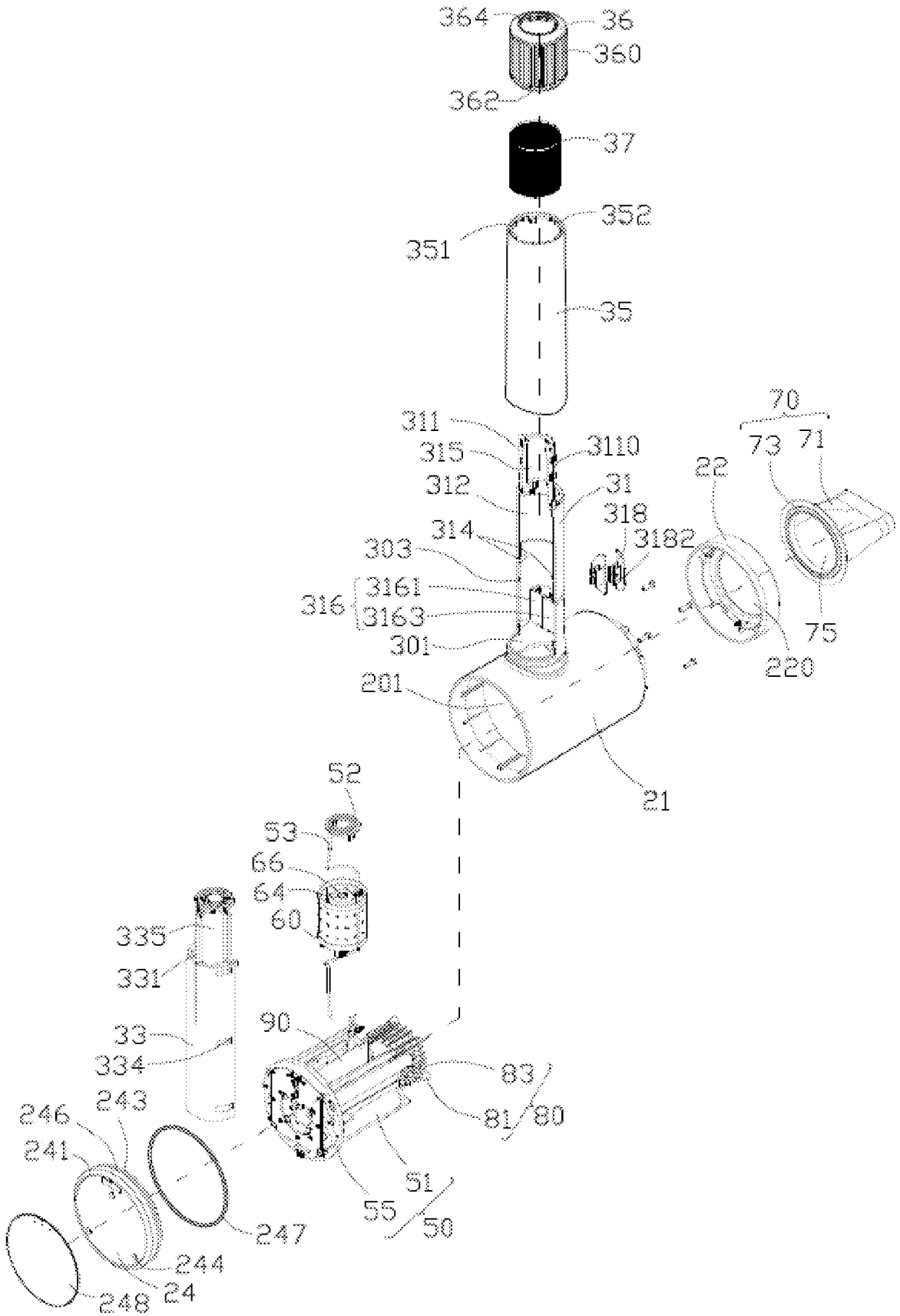
FIG. 9 is an exploded schematic diagram of the three-dimensional structure of the wireless blow dryer illustrated in FIG. 8 from another perspective.

Please refer to FIG. 1 to FIG. 9, the present disclosure provides a wireless blow dryer system 1000, which includes a wireless blow dryer (hereinafter "blow dryer") 100 and a charging socket 400 for charging the blow dryer 100. The blow dryer 100 includes an air duct 20, a handle 30 connected to the air duct 20, an energy storage assembly 50, a fan assembly 60, a heating module assembly 80, and a main control board 90. The main control board 90 is electrically coupled, via wires, to the energy storage assembly 50, the fan assembly 60, and the heating module assembly 80, respectively. As illustrated in FIG. 8 and FIG. 9, the air duct 20 is provided with an air outlet channel 201, and the handle 30 is provided with an air inlet channel 301 communicating with the air outlet channel 201. The energy storage assembly 50 includes at least one energy storage module 51 arranged in the air duct 20, a charging connector 52 arranged at a free end of the handle 30, and wires 53 coupled between the energy storage module 51 and the charging connector 52. The energy storage module 51 may include, but is not limited to, a rechargeable battery, an energy storage capacitor, etc. In the present disclosure, the energy storage module 51 is a rechargeable battery. Preferably, the energy storage assembly 50 includes a plurality of rechargeable batteries 51, which are arranged in the air outlet channel 201 of the air duct 20. The fan assembly 60 includes a motor 64 arranged in the handle 30 and a fan blade 66 connected to the motor 64. The main control board 90 is electrically coupled to the rechargeable battery 51 and the motor 64. The rechargeable battery 51 supplies power to the motor 64, the heating module assembly 80, and the main control board 90. The main control board 90 controls the motor 64 to drive the fan blade 66 to rotate, so that air enters the air inlet channel 301 and exits the air duct 20 through the air outlet channel 201. The heating module assembly 80 is arranged in the air outlet channel 201 to provide the user with hot airflow. In this embodiment, the rechargeable battery 51 is a lithium battery.

In the wireless blow dryer system 1000 provided by the present disclosure, the rechargeable battery 51 of the blow dryer 100 can supply power to the motor 64 and the main control board 90. When in use, the main control board 90 controls the motor 64 to drive the fan blade 66 to rotate to cause airflow, and the airflow enters the blow dryer 100 from the air inlet channel 301, and then exits the air duct 20 through the air outlet channel 201 for the user to use. Therefore, the blow dryer 100 of the present disclosure does not need to be coupled to a mains socket through a power cable, and there is no situation that the power cable is wrapped around a user's arm or other objects. In addition, since the rechargeable battery 51 is provided in the blow dryer 100, the user can use the blow dryer 100 in scenes where there is no mains socket, such as outdoors and other places, so that the blow dryer 100 can be widely used. Moreover, it can also be used when the mains power fails, that is, the blow dryer 100 is not affected by the mains power, which is convenient to use and improves the user experience.

Figure 10:
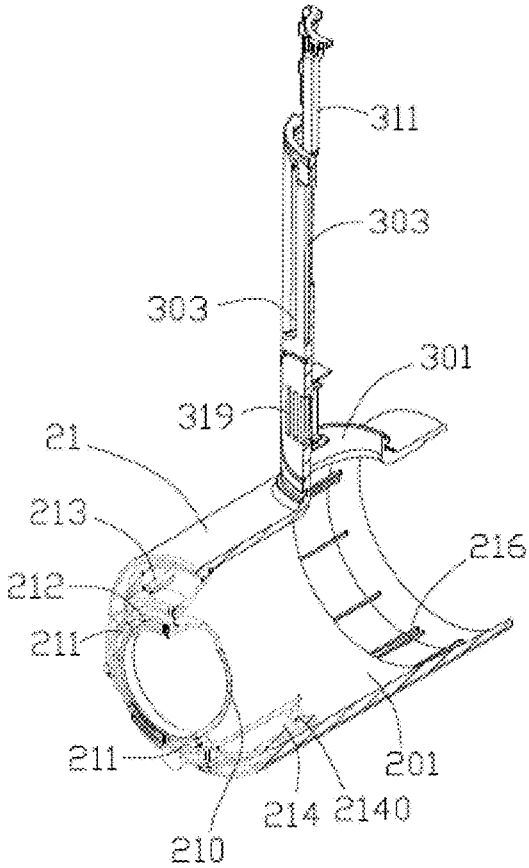
FIG. 10 is a partial cross-sectional view of the three-dimensional structure of a main housing of the wireless blow dryer illustrated in FIG. 9.
Figure 11:
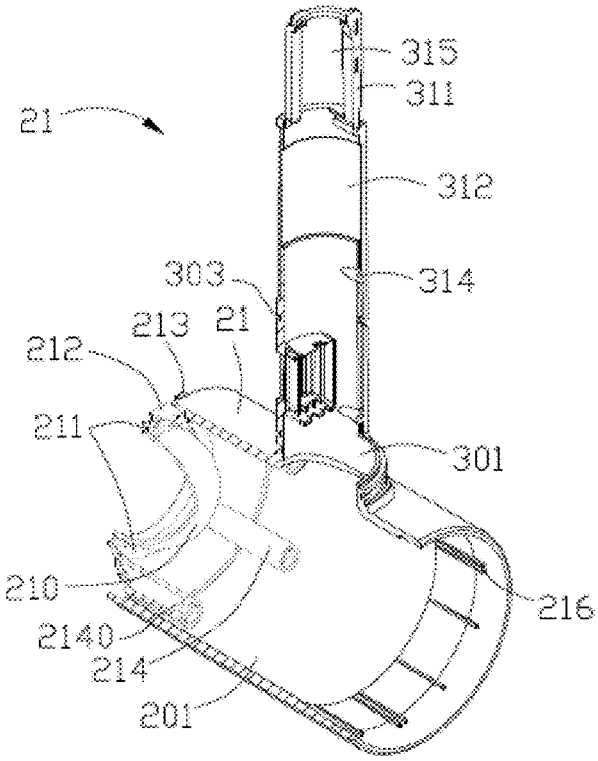
FIG. 11 is a three-dimensional structural diagram of the main housing illustrated in FIG. 10 from another perspective.

The air duct 20 includes a hollow main housing 21, a front housing 22 arranged at a front end of the main housing 21, and a rear cover 24 arranged at a rear end of the main housing 21. The air outlet channel 201 penetrates the main housing 21 along an axial direction of the main housing 21. In this embodiment, the main housing 21 is substantially cylindrical in shape. It can be understandable that, in other embodiments, the main housing 21 may also have other shapes, such as rectangle, ellipse, polygon, etc. The main housing 21 is provided with an air guiding element 210 at a front end of the air outlet channel 201. Specifically, as illustrated in FIG. 8, FIG. 10 and FIG. 11, the air guiding element 210 is a hemispherical structure that is provided at the front end of the main housing 21 and is concave toward the rear end of the main housing 21 along the axial direction of the main housing 21 in the air outlet channel 201. The main housing 21 is provided, at its front end, with an air outlet 211 communicating with the air outlet channel 201 and around the air guiding element 210. In the present embodiment, the air guiding element 210 is configured to guide the airflow in the air outlet channel 201 to an inside wall 2011 of the air outlet channel 201, so that the airflow is concentrated and discharged from the air duct 21 through the air outlet 211, thereby increasing the strength of the wind pressure provided by the blow dryer 100. The main housing 21 is provided with a snapping ring 212 protruding from the front end of the main housing 21 along the axial direction of the main housing 21 and around the air outlet 211, and the front housing 22 is sleeved on the snapping ring 212, so that the front housing 22 can be connected to the main housing 21. In the present disclosure, the front end refers to one end of the blow dryer 100 that faces the user during normal use, and the rear end refers to one end of the blow dryer 100 that is away from the user during normal use. As illustrated in FIG. 8, FIG. 10, FIG. 11, and FIG. 25, the inside wall 2011 of the air outlet channel 201 is provided with a first air guiding surface 2012 at the front end of the air outlet channel 201, and the first air guiding surface 2012 obliquely extends inward in a radial direction of the air duct 20, toward the air guiding element 210, thus further changing flow directions of internal airflow by the first air guiding surface 2012, and thereby increasing the strength of the wind pressure, and improving the wind speed. Alternatively, the first air guiding surface 2012 is annular in shape is annular in shape, thus maintaining uniform air distribution. The first air guiding surface 2012 includes a first end relatively close to the air outlet 211 and a second end relatively far from the air outlet 211, and a radial dimension of the air outlet channel 201 gradually decreases from the first end to the second end of the air outlet channel 201. The air guiding element 210 includes a second air guiding surface 2101 coupled to the first air guiding surface 2012, and the air outlet 211 is arranged at connection between the first air guiding surface 2012 and the second air guiding surface 2101, thus improving the ventilation effect of the blow dryer 100.

The main housing 21 is provided with a plurality of connecting columns 213 protruding from the front end of the main housing 21 and around the snapping ring 212. The connecting columns 213 are configured to connect the front housing 22 to the main housing 21. Specifically, an axial direction of the connecting column 213 is parallel to that of the main housing 21. Each connecting column 213 is provided with a locking hole (not illustrated) along its axial direction, and the front housing 22 is provided with mounting holes (not illustrated) corresponding to the locking holes on the connecting columns 213. In assembly, for each connecting columns 213, a locking member such as a screw passes through the corresponding mounting hole on the front housing 22 and the locking hole on the connecting columns 213 in turn, and then is locked in the locking hole of the connecting column 213, so as to fixedly connect the front housing 22 to the main housing 21. The main housing 21 is provided, at its front end, with a plurality of supporting columns 214 in the side wall of the air outlet channel 201 around the snapping ring 212. The supporting columns 214 are configured to connect the energy storage assembly 50 to the main housing 21. Specifically, each supporting column 214 is provided with a connecting hole 2140 along the axial direction of the main housing 21, and the energy storage assembly 50 is provided with fixing holes 5510 (as illustrated in FIG. 8) corresponding to the connecting holes 2140 on the supporting columns 214. In assembly, for each supporting column 214, a locking member such as a screw is inserted into the connecting hole 2140 of the supporting column 214 and the corresponding fixing hole 5510 on the energy storage assembly 50 in turn, and then locked in the corresponding fixing hole 5510, so as to fix the energy storage assembly 50 to the main housing 21. In this embodiment, the air outlet 211 includes a plurality of air outlet holes provided at the front end of the main housing 21. The plurality of air outlet holes are arranged along a circumferential direction of the snapping ring 212 for at least one circle and evenly spaced. An inner side surface of the air outlet channel 201 is provided, near its rear end, with a plurality of positioning strips 216. The plurality of positioning strips 216 are configured for positioning the energy storage assembly 50. Specifically, the plurality of positioning strips 216 are arranged for one circle along the circumferential direction of the main housing 21.

As illustrated in FIG. 8 to FIG. 9, the front housing 22 defines an air hole 220 corresponding to the air outlet 211, and the front housing 22 is provided with a first adsorbing member 221 on its one end surface away from the main housing 21. In this embodiment, the first adsorbing member 221 is an annular structure. The first adsorbing member 221 is arranged on the end surface of the front housing 22 away from the main housing 21, and surrounds the air hole 220. The blow dryer 100 further includes an air nozzle 70 detachably mounted on the front housing 22. Specifically, the air nozzle 70 includes an air nozzle housing 71 and a second adsorbing member 73. The second adsorbing member 73 is provided on an end surface of the air nozzle housing 71 facing the front housing 22. The air nozzle housing 71 defines an air outlet through hole 75 along its axial direction, and the second adsorbing member 73 is arranged around the air outlet through hole 75. When the air nozzle 70 is mounted on the air duct 20, the first adsorbing member 221 and the second adsorbing member 73 are adsorbed to each other, so that the air nozzle 70 is positioned on the air duct 20, and the air outlet through hole 75 communicates with the air hole 220. In this embodiment, both the first adsorbing member 221 and the second adsorbing member 73 are magnets. The first adsorbing member 221 and the second adsorbing member 73 are positioned by the adsorption between the guide poles of the magnet.

In other embodiments, the first adsorbing member 221 is an iron ring, and the second adsorbing member 73 is a magnet. Alternatively, the first adsorbing member 221 is a magnet, and the second adsorbing member 73 is an iron ring.

In other embodiments, the first adsorbing member 221 is an electromagnet electrically coupled to the rechargeable battery 51, and the second adsorbing member 73 is a magnet or an iron block. Specifically, in one of the embodiments, the first adsorbing member 221 is kept electrically coupled to the rechargeable battery 51, to make the first adsorbing member 221 be able to maintain magnetic properties, so that the second adsorbing member 73 can be adsorbed to the first adsorbing member 221. In another embodiment, the blow dryer 100 is further provided with a switch for controlling electrical coupling between the first adsorbing member 221 and the rechargeable battery 51. When the air nozzle 70 is needed, the switch is turned on, so that the first adsorbing member 221 is energized and has magnetism, so as to realize the absorption connection between the first adsorbing member 221 and the second adsorbing member 73. When the air nozzle 70 needs to be removed, the switch is turned off to disconnect the electrical coupling between the first adsorbing member 221 and the rechargeable battery 51, so that the first adsorbing member 221 is power off and the magnetism of the first adsorbing member 221 disappears, so as to facilitate the removal of the air nozzle 70.

The rear cover 24 is connected to the rear end of the main housing 21 to position the energy storage assembly 50 into the main housing 21. Specifically, the rear cover 24 includes a cover plate 241 and a flange 243 protruding from the edge of an end surface of the cover plate 241 facing the main housing 21. The cover plate 241 is provided, at its one end surface away from the main housing 21, with a plurality of counterbore holes 244. In assembly, a plurality of locking members such as screws passes through the counterbore holes 244 on the cover plate 241 and are locked to the rear end of the main housing 21, so as to fix the rear cover 24 to the rear end of the main housing 21. The flange 243 is provided, at its outer side surface, with a positioning slot 246 along its circumferential direction. The rear cover 24 further includes a sealing ring 247 received in the positioning slot 246 and a decorative sheet 248 attached to one end surface of the cover plate 241 away from the main housing 21. The sealing ring 247 is configured to seal the rear end of the air outlet channel 201 to prevent the airflow from flowing out of the air duct 20 through the rear end of the air duct 20, so as to ensure that the wind pressure of the airflow being out of the air duct 20 through the front end of the air duct 20 is not affected. The decoration sheet 248 is configured to decorate the appearance of the blow dryer 100.

The wires 53 are arranged in a side wall of the handle 30. Specifically, the handle 30 is provided with a wire slot 303 at its side wall, and the wires 53 are received in the wire slot 303, so as to prevent the wires 53 from occupying the space of the air inlet channel 301 of the handle 30. Therefore, the wires 53 will not block the airflow caused by the fan assembly 60, which can keep the air inlet channel 301 smooth, so that the wind pressure provided by the blow dryer 100 is stronger and more concentrated, and the work efficiency is higher, which improves the user experience.

Referring to FIG. 3 to FIG. 9 again, in this embodiment, the handle 30 includes a handle body 31 connected to the air duct 20, a handle cover 33 detachably buckled on the handle body 31, and a hollow sleeve 35 sleeved on the outer surfaces of the handle body 31 and the handle cover 33. The handle body 31 is buckled with the handle cover 33 to form a cylindrical body. The fan assembly 60 is clamped between the handle body 31 and the handle cover 33, and the wires 53 are arranged between the sleeve 35 and the handle body 31 and/or the handle cover 33. Specifically, the handle body 31 is provided with a wire slot 303 on its outer peripheral surface. The wire slot 303 extends from one end of the handle body 31 to the other end of the handle body 31 along the length direction of the handle body 31. The wires 53 are received in the wire slot 303, and the sleeve 35 is sleeved on the handle body 31 to position the wires 53.

In other embodiments, the handle cover 33 may also be provided with a wire slot on its outer peripheral surface. The wire slot extends from one end of the handle cover 33 to an opposite end of the handle cover 33. The wires 53 are received in the wire slot, and the sleeve 35 is sleeved on the handle cover 33 to position the wires 53.

In other embodiments, the inner side surface of the handle body 31 and/or the handle cover 33 is provided with a wire slot along the extending direction of the air inlet channel 301, and the wires 53 are clamped in the wire slot.

In other embodiments, the side wall of the handle body 31 and/or the handle cover 33 is provided with a wire slot along the extending direction of the air inlet channel 301, and the wires 53 are inserted into the wire slot.

As illustrated in FIG. 6 to FIG. 9, in this embodiment, a radial cross section of the handle body 31 is in a semicircular ring shape. The handle body 31 is provided, on its inner side surface, with a positioning groove 312 at its one end away from the main housing 21. The positioning groove 312 is configured to receive and position the fan assembly 60. The handle body 31 is provided, at a position of its one side wall connected to the handle cover 33, with a plurality of connecting holes 314. The handle body 31 is provided with a tail frame 311 at its free end. The tail frame 311 is provided with an air inlet 315 communicating with the air inlet channel 301, that is, the air inlet 315 is located at one end of the handle body 31 away from the main housing 21. The tail frame 311 is provided with clamping holes 3110 on its one side surface facing the handle cover 33.

Figure 7:
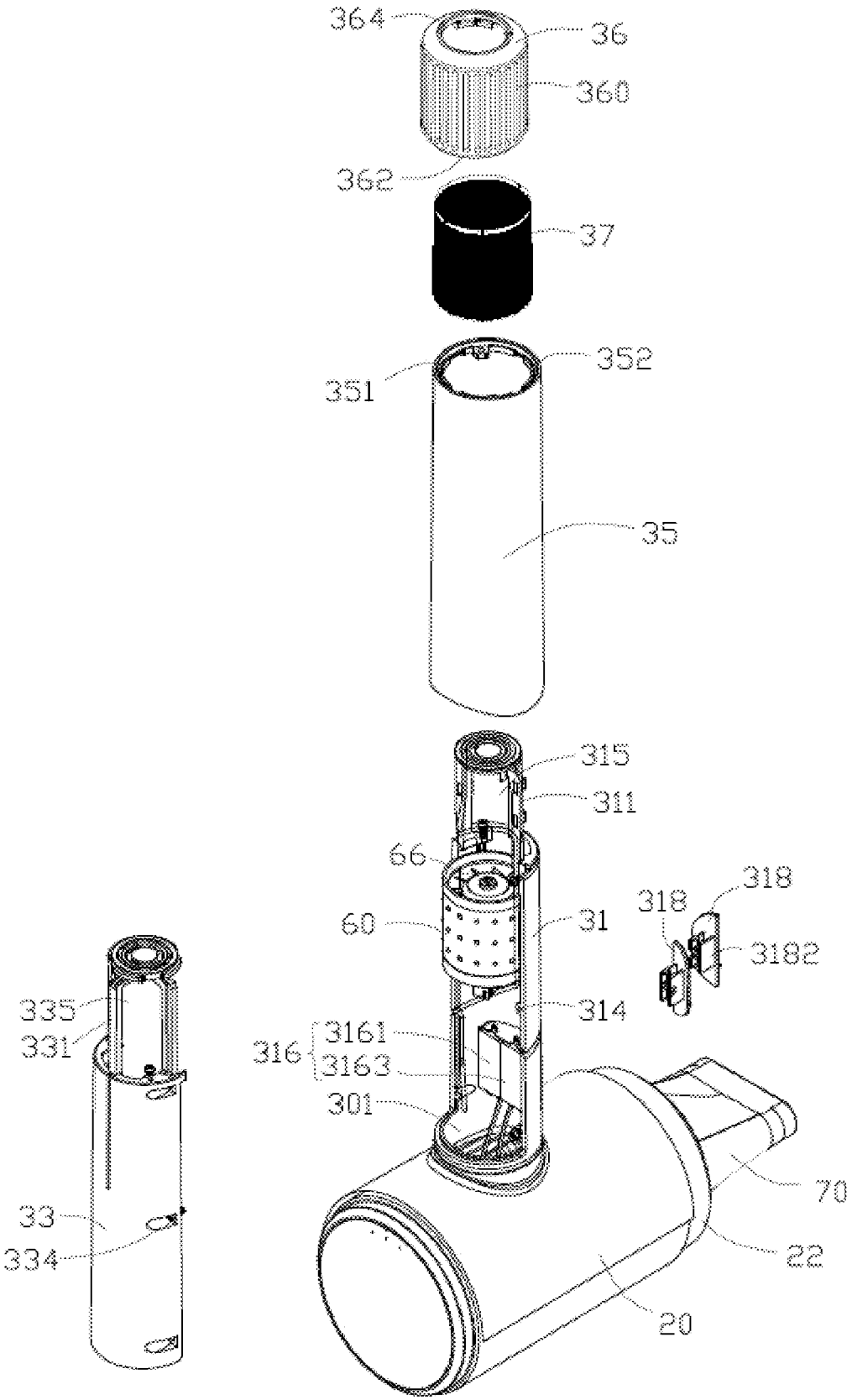
FIG. 7 is a schematic diagram of the three-dimensional structure of the wireless blow dryer illustrated in FIG. 6 from another perspective.

As illustrated in FIG. 7 and FIG. 9, the blow dryer 100 further includes a switch module 316 electrically coupled to the main control board 90. The main control board 90 controls, according to the signal received from the switch module 316, working states of the rechargeable battery 51, the motor 64, and/or the heating module assembly 80. Specifically, the handle body 31 is provided, on its inner side surface, with a first control switch 3161 and a second control switch 3163 at a position close to the main housing 21. The first control switch 3161 and the second control switch 3163 are coupled to the main control board 90 through the wires 53. The first control switch 3161 is configured to control the wind volume caused by the fan assembly 60, that is, the first control switch 3161 is configured to control the power of the motor 64 to adjust the rotation speed of the fan blade 66, so as to realize the adjustment of the wind volume. The second control switch 3163 is configured to control working states of the heating assembly 80, that is, to control the heating module assembly 80 to generate heat. That is, the second control switch 3163 is configured to control whether to turn on the heating module assembly 80 and adjust the power of the heating module assembly 80, so as to adjust the temperature of the airflow. The first control switch 3161 and the second control switch 3163 are respectively driven by a toggle button 318, so as to realize the operation of the first control switch 3161 and the second control switch 3163.

As illustrated in FIG. 6 to FIG. 9, the handle body 31 is provided, on its outer side surface, with sliding slots 319 spaced apart from each other at positions corresponding to the first control switch 3161 and the second control switch 3163, respectively. Two toggle buttons 318 are respectively inserted into the corresponding sliding slots 319 and connected to the first control switch 3161 and the second control switch 3163.

Figure 12:
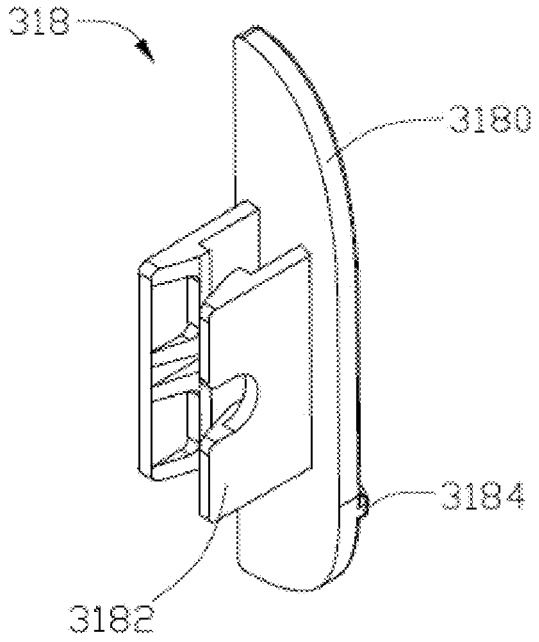
FIG. 12 is an enlarged view of a toggle button of the wireless blow dryer illustrated in FIG. 9.

As illustrated in FIG. 12, each toggle button 318 includes a toggle piece 3180, two spaced guiding hooks 3182 arranged on one side surface of the toggle piece 3180, and anti-slip strips 3184 arranged on an opposite side surface of the toggle piece 3180. The two sliding guiding hooks 3182 are respectively inserted into the corresponding sliding slots 319 on the handle body 31, so that the toggle button 318 is slidably connected to the handle body 31 through the sliding slot 319, and the two toggle buttons 318 are respectively connected to the first control switch 3161 and the second control switch 3163. The anti-slip strips 3184 are configured to facilitate operation of the toggle button 318 by user.

Figure 6:
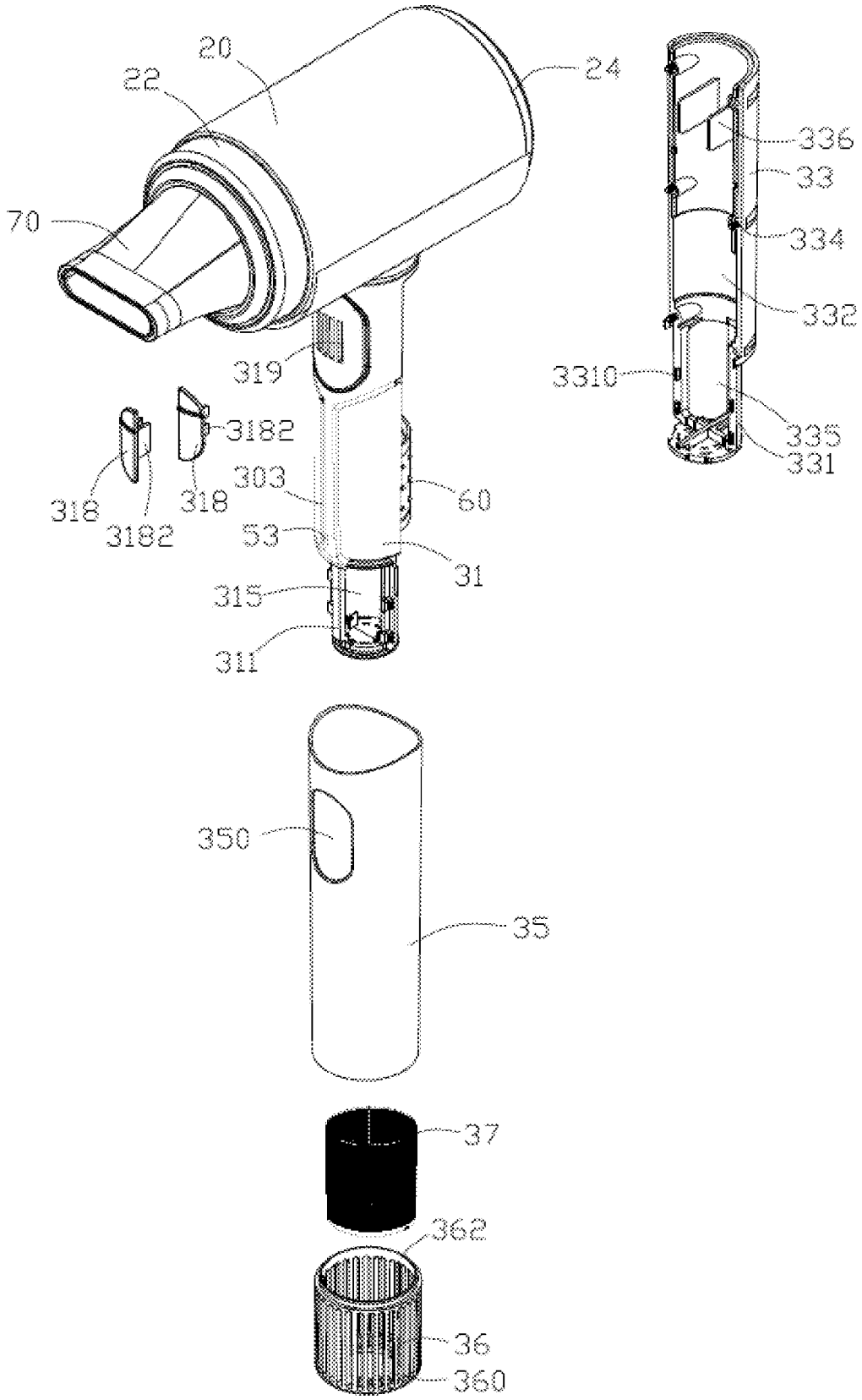
FIG. 6 is a further exploded schematic diagram of the three-dimensional structure of the handle of the wireless blow dryer illustrated in FIG. 4.

Please refer to FIG. 6 to FIG. 9 again, the structure of the handle cover 33 is similar to that of the handle body 31. Specifically, a radial cross section of the handle cover 33 is in a semicircular shape. The handle cover 33 is provided, on its inner side surface, with a positioning groove 332 at its one end away from the main housing 21. The positioning groove 332 is configured to receive and position the fan assembly 60. The handle cover 33 is provided, at a position of its one side wall connected to the handle body 31, with a plurality of through holes 334 corresponding to the connecting holes 314 defined on the handle body 31. The handle cover 33 is provided with a tail frame 331 at its free end. The tail frame 331 is provided with an air inlet 335 communicating with the air inlet channel 301, that is, the air inlet 335 is located at one end of the handle cover 33 away from the main housing 21. The tail frame 331 is provided with clamping blocks 3310 on its one side surface facing the handle body 31. When the handle body 31 and the handle cover 33 are buckled together, the clamping blocks 3310 on the tail frame 331 are respectively clamped into the corresponding clamping holes 3110 on the tail frame 311. Locking members such as screws pass through the through hole 334 on the handle cover 33 and the corresponding connecting hole 314 on the handle body 31 in turn, and then are locked in the corresponding connecting holes 314, so as to fix the handle body 31 and the handle cover 33 together, the fan assembly 60 is clamped between the handle body 31 and the handle cover 33, and the air inlet 315 of the tail frame 311 communicates with the air inlet 335 of the tail frame 331 to form a complete air inlet. The handle cover 33 is provided with two abutting pieces 336 on its inner side surface close to the main housing 21. The two abutting pieces 336 are configured to abut the first control switch 3161 and the second control switch 3163. The extending direction of each abutting piece 336 is parallel to the extending direction of the air inlet channel 301, so as to reduce the obstruction of the abutting pieces 336 to the airflow. In other embodiments, the abutting piece 336 can also be omitted, or abutting needles can be used to replace the abutting pieces 336, so as to further reduce the obstruction to the airflow.

Figure 4:
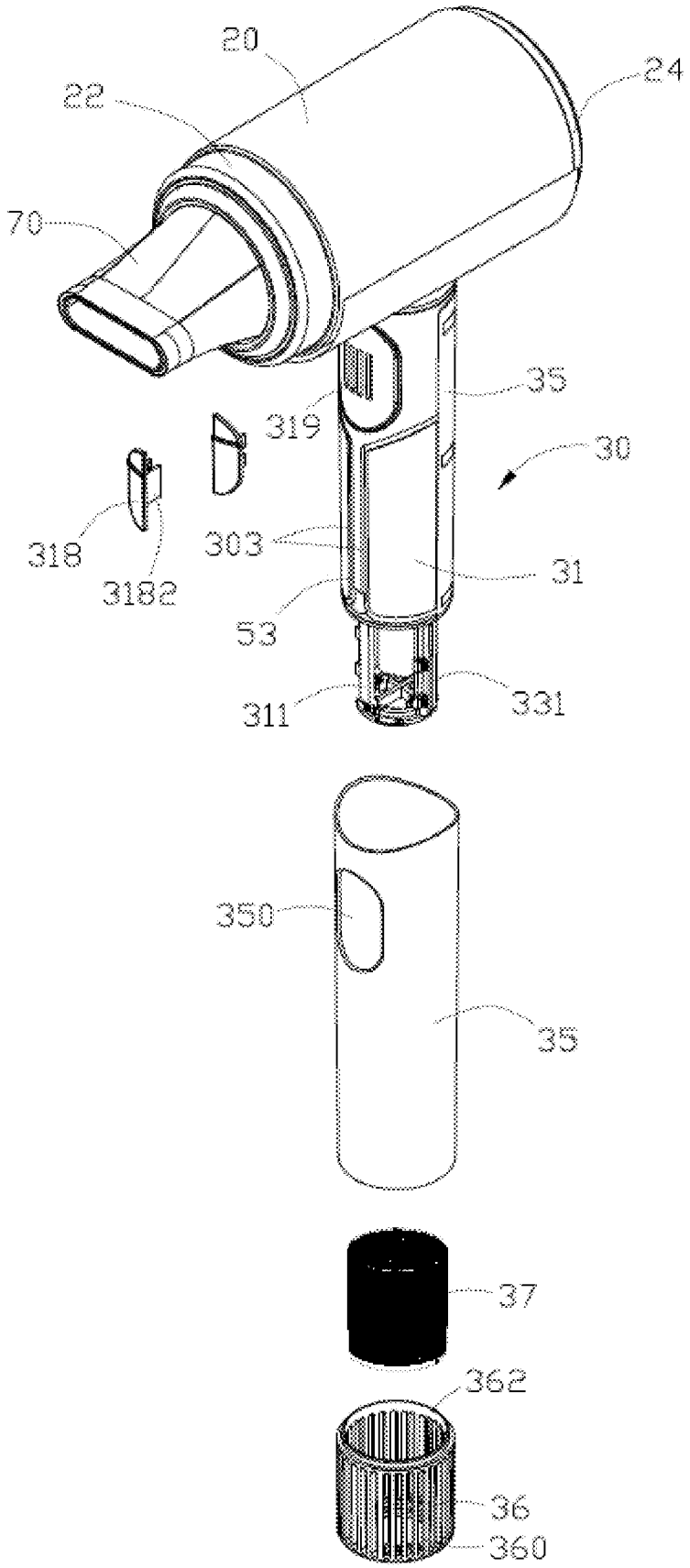
FIG. 4 is a partial exploded schematic diagram of the three-dimensional structure of a handle of the wireless blow dryer illustrated in FIG. 3.
Figure 5:
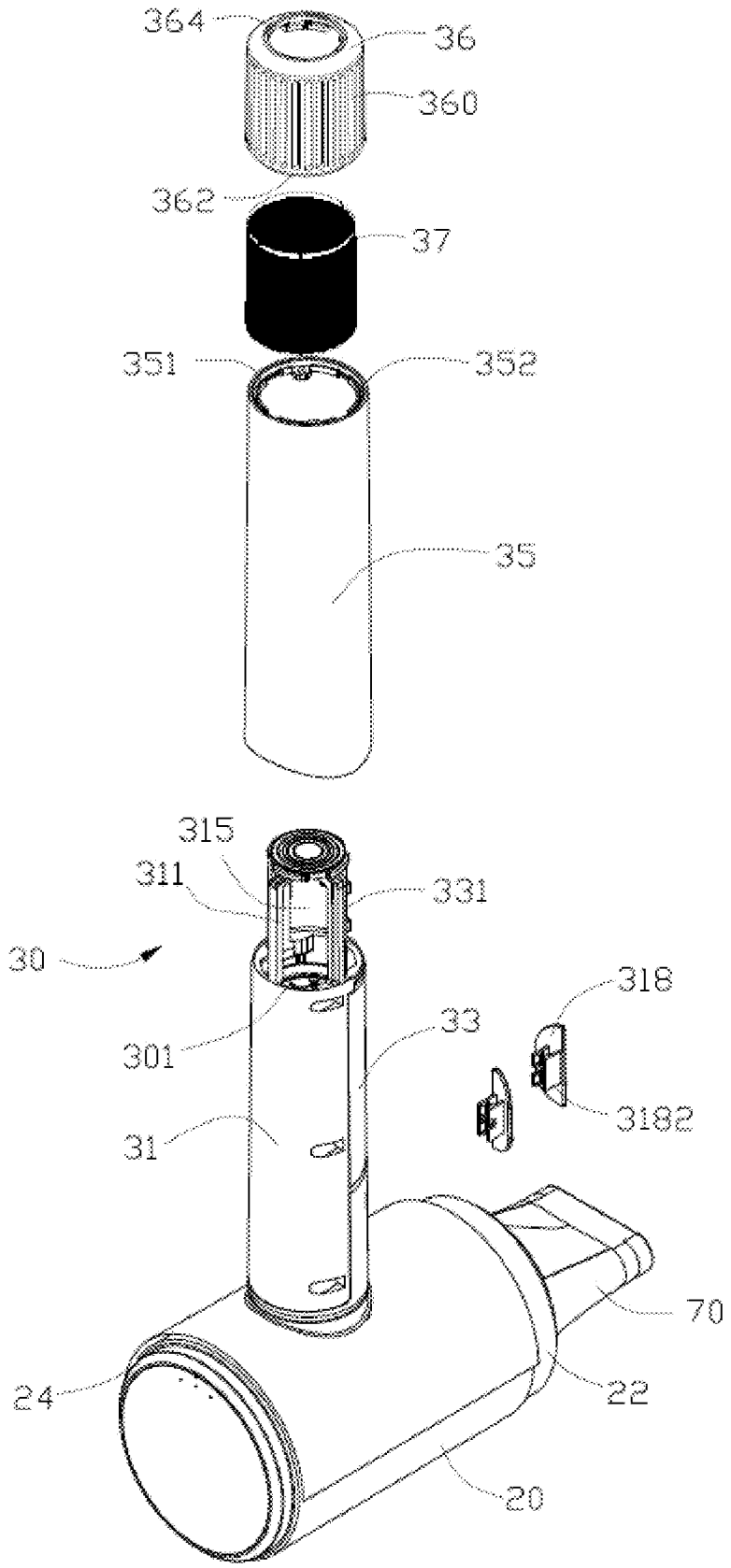
FIG. 5 is a schematic diagram of the three-dimensional structure of the wireless blow dryer illustrated in FIG. 4 from another perspective.

Please refer to FIG. 4 and FIG. 5 again, the sleeve 35 is provided, on its side wall, with a guiding groove 350 communicating with an inner cavity of the sleeve 35 and corresponding to the toggle button 318. The toggle button 318 is able to slide in the guiding groove 350. The sleeve 35 is provided with a connecting ring 351 on its one end surface away from the main housing 21. The connecting ring 351 is provided with a clamping slot 352 along the circumferential direction of the sleeve 35.

The handle 30 further includes a tail cover 36. The tail cover 36 is detachably connected to a free end of the handle body 31 and/or a free end of the handle cover 33. The tail cover 36 is provided with a plurality of air inlet holes 360. When the tail cover 36 is connected to the handle body 31 and/or the handle cover 33, the air inlet holes 360 communicate with the air inlets 315 and 335. Specifically, the tail cover 36 has a cylindrical structure, and the tail cover 36 is provided with a plurality of strip-shaped air inlet holes 360 on its side wall. The air inlet holes 360 are arranged along the circumferential direction of the tail cover 36, and extend along the axial direction of the tail cover 36. Preferably, the air inlet holes 360 are arranged at even intervals along the circumferential direction of the tail cover 36. The air inlet hole 360 is configured to allow the outside air to enter the air inlets 315 and 335 from the air inlet holes 360 on the tail cover 36, and then enter the air inlet channel 301. In this embodiment, the tail cover 36 is detachably sleeved on the outer surface of the tail frame 311 of the handle body 31 and the tail frame 331 of the handle cover 33, and is detachably connected with a tail end of the sleeve 35. Specifically, the tail cover 36 is provided with a clamping strip 362 on its one end surface facing the sleeve 35. The clamping strip 362 is arranged along the circumferential direction of the tail cover 36. The clamping strip 362 of the tail cover 36 is detachably clamped into the clamping slot 352 of the sleeve 35, so as to connect the tail cover 36 to the tail end of the sleeve 35. The tail cover 36 is provided with a mounting hole 364 at its one end away from the clamping strip 362, and the mounting hole 364 is configured to fix the charging connector 52.

Figure 14:
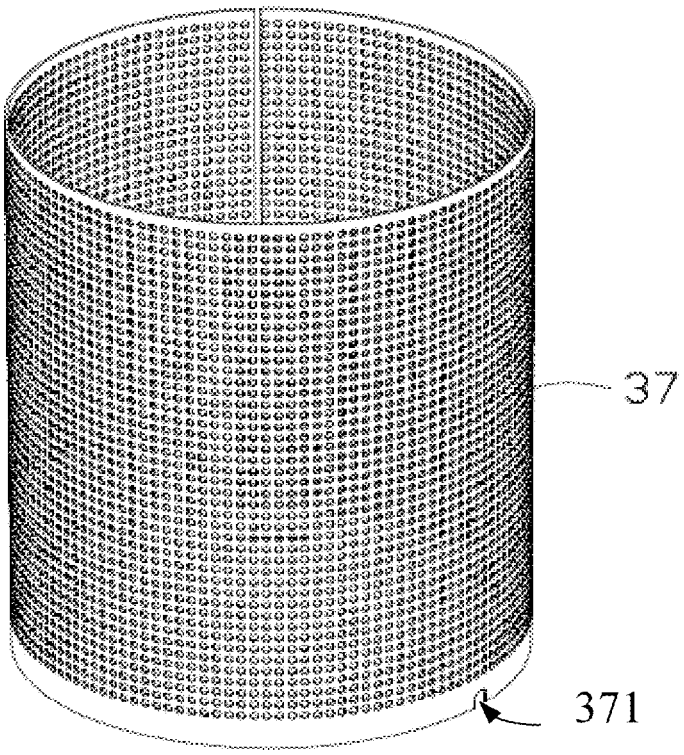
FIG. 14 is an enlarged view of a filter mesh of the wireless blow dryer illustrated in FIG. 4.

Preferably, the blow dryer 100 further includes a detachable filter mesh 37 arranged between the tail cover 36 and the handle body 31 and/or the handle cover 33. In this embodiment, the filter mesh 37 has a cylindrical structure. The filter mesh 37 is detachably arranged between the tail cover 36 and the tail frame 311 of the handle body 31 and the tail frame 331 of the handle cover 33. The filter mesh 37 is configured to filter dust contained in the airflow entering the air inlets 315 and 335. As illustrated in FIG. 14, the filter mesh 37 is provided with a notch 371 on its one end portion. The notch 371 is clamped to a positioning protrusion (not illustrated) provided on the tail cover 36, so that the filter mesh 37 is positioned in the tail cover 36. In other embodiments, the notch 371 of the filter mesh 37 can also be clamped to a positioning protrusion (not illustrated) provided on the tail frame 311 of the handle body 31 or the tail frame 331 of the handle cover 33, so that the filter mesh 37 is positioned on the handle body 31 or the handle cover 33.

Figure 13:
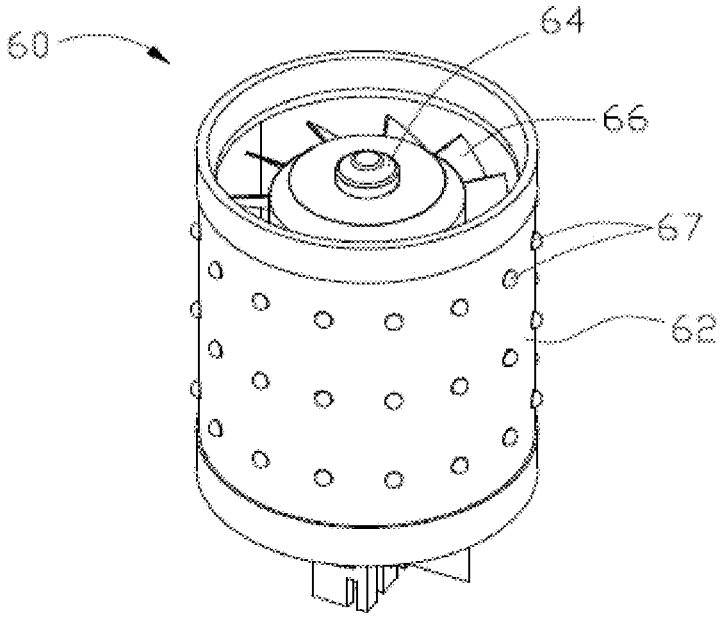
FIG. 13 is an enlarged view of a fan assembly of the wireless blow dryer illustrated in FIG. 9.

Please refer to FIG. 13, the fan assembly 60 includes an air inlet cylinder 62, a motor 64, and a fan blade 66 connected to the motor 64. The motor 64 and the fan blade 66 are arranged in the air inlet cylinder 62. When the air inlet cylinder 62 is clamped between the handle body 31 and the handle cover 33, a rotation axis of the fan blade 66 is collinear with an axis center line of the air inlet channel 301. The air inlet cylinder 62 is provided with a plurality of positioning protrusions 67 on its outer peripheral surface. The plurality of positioning protrusions 67 abut against the inner peripheral surface of the handle body 31 and the inner peripheral surface of the handle cover 33, so that the fan assembly 60 is able to be firmly positioned in the handle 30.

Please refer to FIG. 8 to FIG. 9 and FIG. 15 to FIG. 18, the energy storage assembly 50 further includes a cell bracket 55 for mounting the plurality of rechargeable batteries 51. The plurality of rechargeable batteries 51 are positioned in parallel and spaced apart on the cell bracket 55, and the plurality of rechargeable batteries 51 are coupled in series. Preferably, the plurality of rechargeable batteries 51 are arranged along the circumferential direction of the cell bracket 55. Furthermore, the plurality of rechargeable batteries 51 are evenly spaced along the circumferential direction of the cell bracket 55. In this embodiment, the cell bracket 55 includes a connecting plate 550 and a plurality of spaced supporting columns 551 arranged on the connecting plate 550. The plurality of supporting columns 551 are arranged along the circumferential direction of the cell bracket 55 and extend along the axial direction of the cell bracket 55, and correspond to the plurality of supporting columns 214 of the main housing 21 one by one. Each supporting column 551 is provided with a fixing hole 5510 at its one end along the axial direction of the supporting column 551. In assembly, for each supporting column 551 and its corresponding supporting column 214, a locking member such as a screw is inserted into the connecting hole 2140 on the supporting column 214 and the corresponding fixing hole 5510 on the supporting column 551 in turn, and then locked in the corresponding fixing hole 5510, so as to fix the cell bracket 55 to the main housing 21.

The main control board 90 is arranged between two adjacent supporting columns 551, and a positioning ring 553 is arranged between every two adjacent supporting columns 551 of the remaining supporting columns 551. The plurality of rechargeable batteries 51 are respectively positioned in corresponding positioning rings 553. Specifically, the connecting plate 550 is a circular plate, and the plurality of supporting columns 551 are arranged at intervals along the circumferential direction of the connecting plate 550. In this embodiment, the number of supporting columns 551 is four, that is, four supporting columns 551 are arranged at intervals along the circumferential direction of the connecting plate 550. The number of rechargeable batteries 51 is six. The positioning ring 553 arranged between two adjacent supporting columns 551 is substantially in a shape of a gourd. Each positioning ring 553 can position two parallel spaced rechargeable batteries 51, that is, two rechargeable batteries 51 are positioned between two adjacent supporting columns 551.

Figure 17:
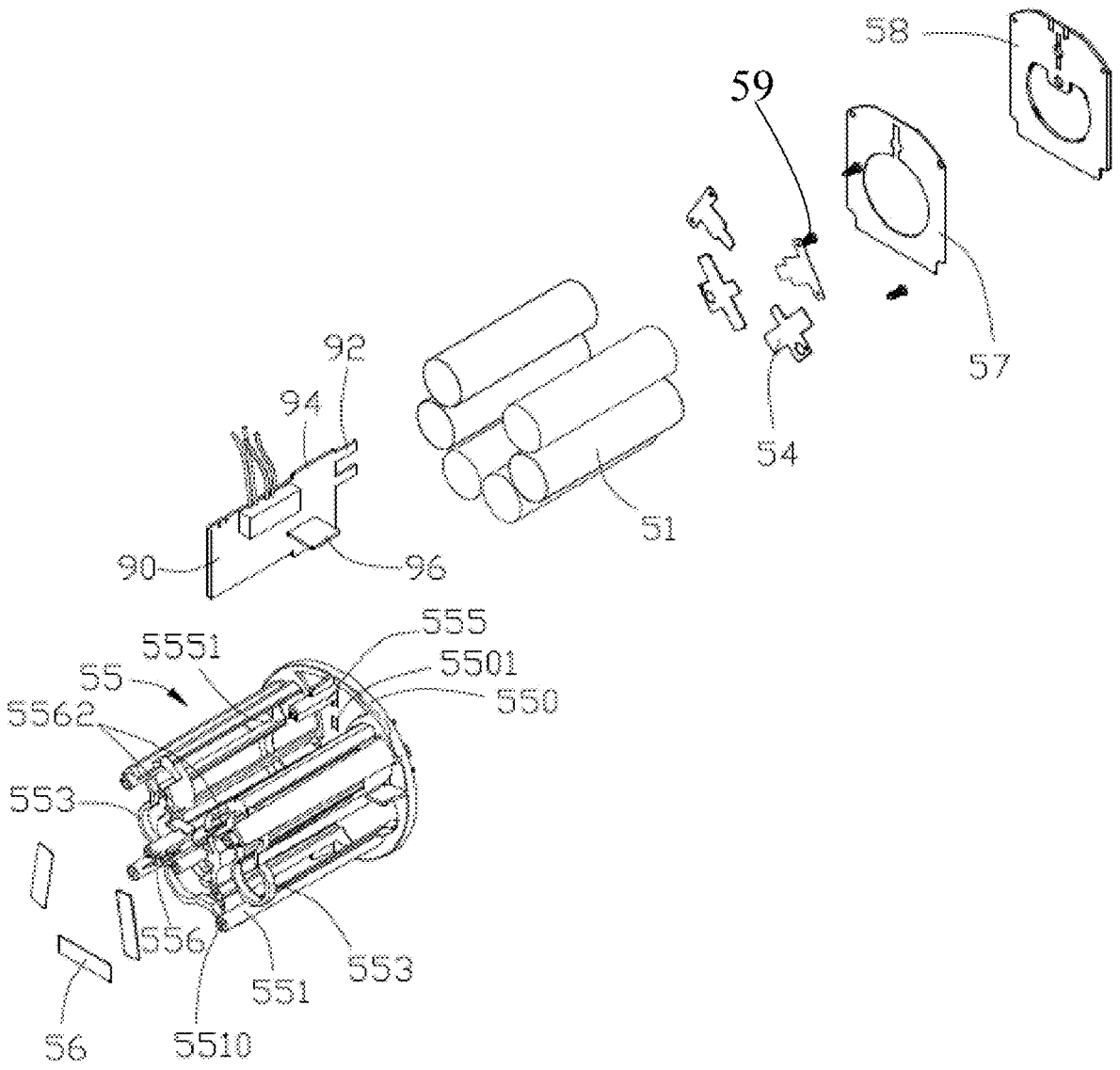
FIG. 17 is an exploded schematic diagram of the three-dimensional structure of the energy storage assembly illustrated in FIG. 15.
Figure 18:
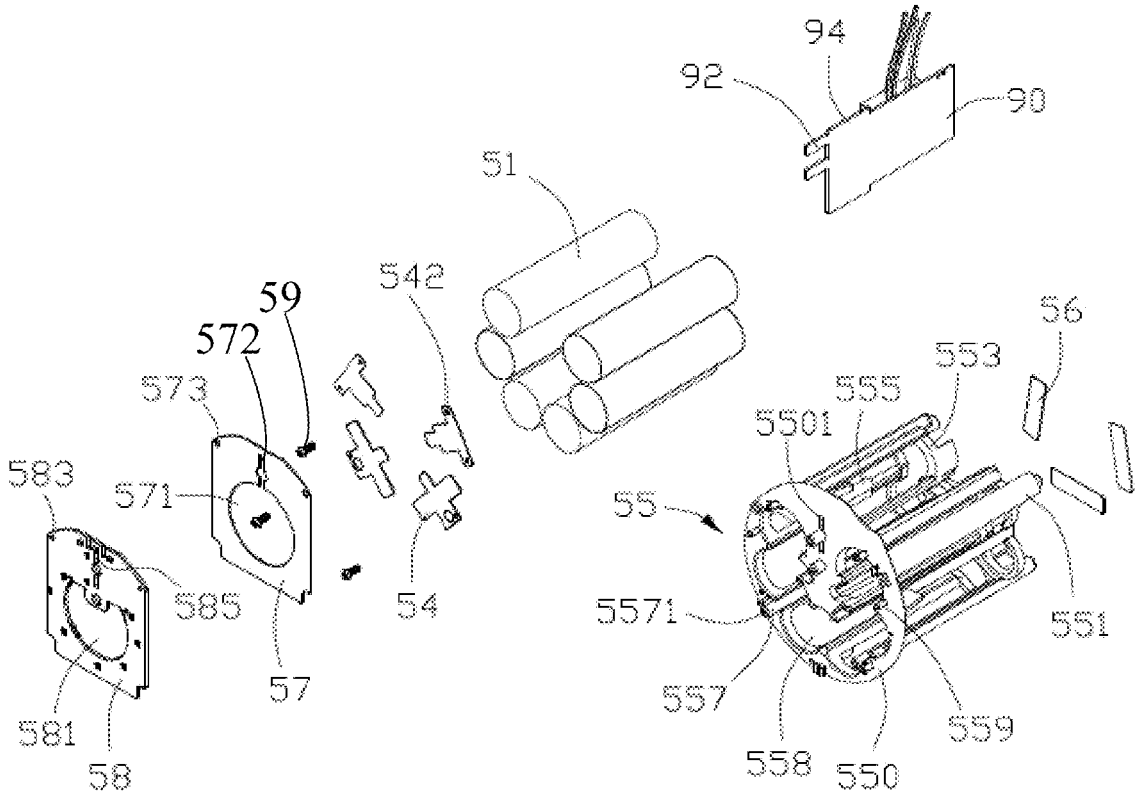
FIG. 18 is a schematic diagram of the three-dimensional structure of the energy storage assembly illustrated in FIG. 17 from another perspective.

As illustrated in FIG. 17, the cell bracket 55 is provided with a positioning member 555, which is configured to connect to the main control board 90. Specifically, the positioning member 555 is a positioning column extending from the connecting plate 550 in a direction parallel to an axial direction of the supporting column 551. The positioning column is provided with a positioning groove 5551 on its side surface along its axial direction. The connecting plate 550 is provided with two positioning holes 5501 at a position adjacent to the positioning member 555. The positioning member 555 and the positioning holes 5501 are configured to jointly fix the main control board 90 to the cell bracket 55. The cell bracket 55 is further provided with a connecting member 556 in the middle of an end of the cell bracket 55 away from the connecting plate 550. The connecting member 556 is provided with staggered clamping slots 5562 around the connecting member 556. The heating module assembly 80 is fixed to the cell bracket 55 through the connecting member 556 and the clamping slots 5562. As illustrated in FIG. 18, the connecting plate 550 is further provided with a plurality of fixing columns 557 on its one side surface away from the supporting column 551, and each fixing column 557 is provided with a fixing hole 5571 along its axial direction. The connecting plate 550 defines an opening 558 corresponding to an inner cavity of the positioning ring 553. The connecting plate 550 is further provided, on its one side surface away from the supporting column 551, with clamping columns 559 around the opening 558.

In other embodiments, every two adjacent supporting columns 551 can be configured to position one rechargeable battery 51 or two or more rechargeable batteries 51, which can be freely selected according to needs.

The energy storage assembly 50 further includes a plurality of first connecting pieces 54 connected to one end of the plurality of rechargeable batteries 51 and a plurality of second connecting pieces 56 connected to the opposite ends of the plurality of rechargeable batteries 51. In this embodiment, each first connecting piece 54 and each second connecting piece 56 are nickel pieces. The plurality of rechargeable batteries 51 are coupled in series through the plurality of first connecting pieces 54 and the plurality of second connecting pieces 56. Each first connecting piece 54 defines one or more clamping holes 542. The energy storage assembly 50 further includes a gasket 57 and a protection module 58. The gasket 57 is provided with a through hole 571 defined on its middle portion, clamping holes 573 corresponding to the clamping columns 559 on the connecting plate 550 one by one, and a positioning hole 572 corresponding to the positioning holes 5501 on the connecting plate 550. In this embodiment, the protection module 58 is a sheet structure. The protection module 58 is provided with a through hole 581 defined on its middle portion, clamping holes 583 corresponding to the clamping columns 559 on the connecting board 550 one-to-one, and two positioning holes 585 corresponding to the two positioning holes 5501 on the connecting plate 550 one by one. The main control board 90 is provided with clamping pieces 92 extending from one end of the main control board 90, and an inserting piece 94 adjacent to the clamping piece 92 on its one side. In this embodiment, the main control board 90 is provided with two clamping pieces 92 spaced apart, which extend from one end of the main control board 90 and correspond to the two positioning holes 5501 on the connecting plate 550 one by one.

When assembling the energy storage assembly 50 and the main control board 90, as illustrated in FIG. 17 to FIG. 18, the plurality of rechargeable batteries 51 are inserted into the cell bracket 55 from the openings 558 of the cell bracket 55, so that one end of each rechargeable battery 51 is inserted into the inner cavity of the corresponding positioning ring 553. The plurality of first connecting pieces 54 are respectively clamped on the clamping columns 559 of the connecting plate 550, that is, each clamping column 559 on the connecting plate 550 is clamped into the corresponding hole 542 on the first connecting piece 54. The gasket 57 is attached to one side surface of the protection module 58 facing the cell bracket 55, and then the protection module 58 is positioned on the connecting plate 550, that is, each clamping column 559 on the connecting plate 550 passes through the corresponding clamping hole 573 on the gasket 57 and the corresponding clamping hole 583 on the protection module 58 in turn, and a locking member 59 is locked to one free end of each clamping column 559 from one side of the protection module 58 away from the connecting plate 550, so that the protection module 58 and the gasket 57 are both fixed to the connecting plate 550. The plurality of second connecting pieces 56 are connected to the ends of the plurality of rechargeable batteries 51 away from the connecting plate 550. At this time, the plurality of rechargeable batteries 51 are fixed to the cell bracket 55, and the plurality of rechargeable batteries 51 are coupled in series. The main control board 90 is mounted to the cell bracket 55. Specifically, each of the two clamping pieces 92 of the main control board 90 is inserted into the corresponding positioning hole 5501 on the connecting plate 550, the corresponding positioning hole 572 on the gasket 57, and the corresponding positioning hole 585 on the protection module 58 in turn, and the inserting piece 94 of the main control board 90 is clamped into the positioning slot 5551 on the positioning member 555, so that the main control board 90 is fixed to the cell bracket 55. At this time, a length direction of the main control board 90 is parallel to the axis of the rechargeable batteries 51.

The blow dryer 100 further includes a battery protection module 96 coupled to the main control board 90. The battery protection module 96 is electrically coupled to the rechargeable batteries 51 and the main control board 90. The battery protection module 90 is configured to protect the rechargeable batteries 51. In this embodiment, the battery protection module 96 is a circuit board electrically coupled to the main control board 90. The battery protection module 96 is configured to effectively protect the rechargeable batteries 51 in the blow dryer 20, that is, to provide over-charge protection, over-discharge protection, over-current protection and short-circuit protection, etc., for the rechargeable batteries 51.

In other embodiments, the battery protection module 96 can also be arranged in other positions of the blow dryer 20, such as in the cell bracket 55. The battery protection module 96 is coupled to the main control board 90 through wires.

In other embodiments, the battery protection module 96 may also be arranged in the charging socket 400.

In other embodiments, the main control board 90 is provided with a battery protection circuit module, that is, the battery protection circuit is directly arranged in the main control board 90.

Figure 15:
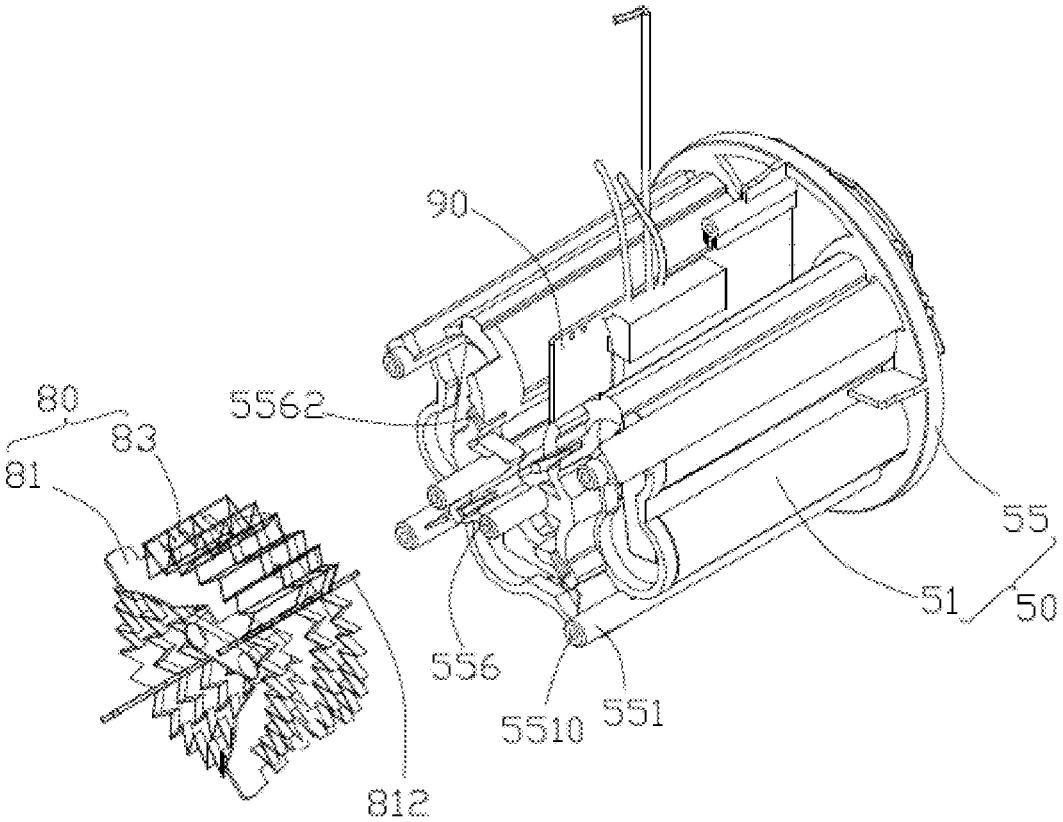
FIG. 15 is an exploded schematic diagram of the three-dimensional structure of an energy storage assembly and a heating module assembly of the wireless blow dryer illustrated in FIG. 8.
Figure 16:
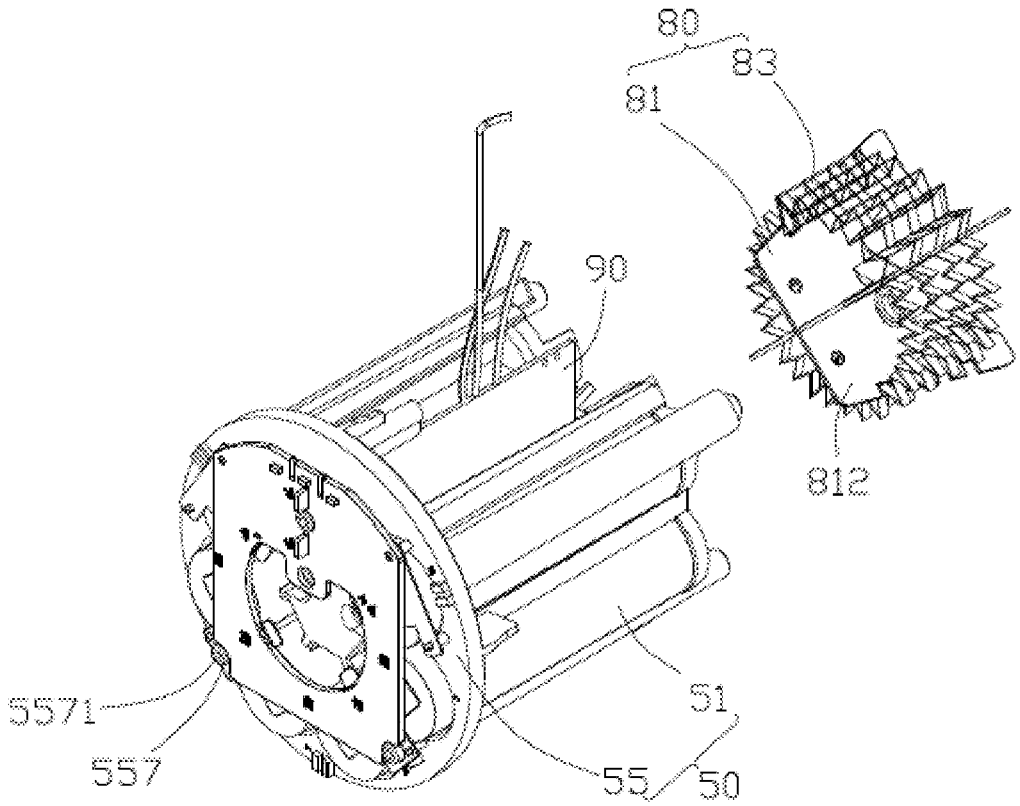
FIG. 16 is a schematic diagram of the three-dimensional structure of the energy storage assembly and the heating module assembly illustrated in FIG. 15 from another perspective.
Figure 19:
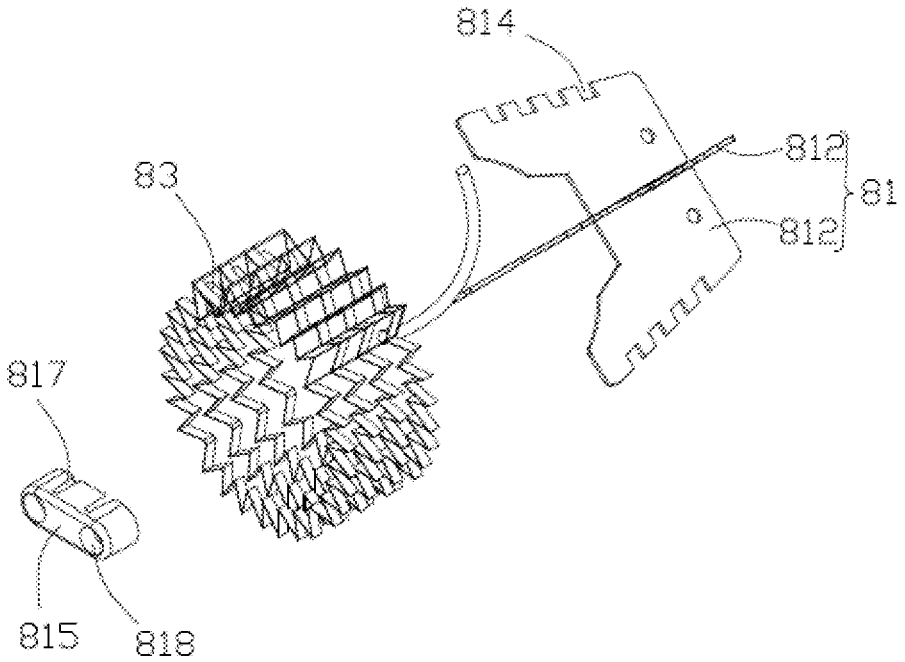
FIG. 19 is an exploded schematic diagram of the three-dimensional structure of the heating module assembly illustrated in FIG. 15.
Figure 20:
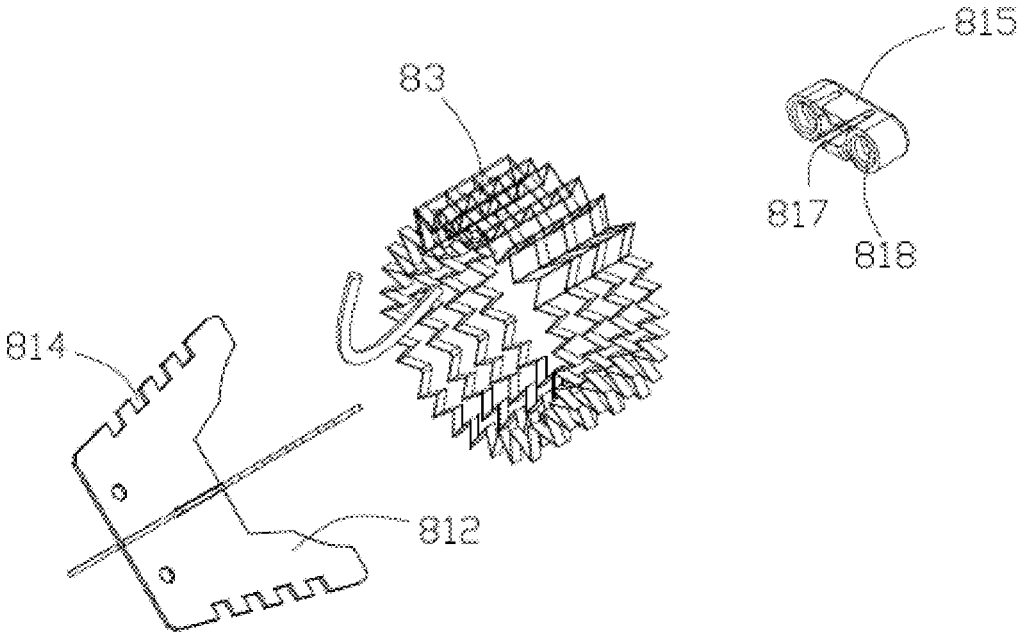
FIG. 20 is a schematic diagram of the three-dimensional structure of the heating module assembly illustrated in FIG. 19 from another perspective.
Figure 21:
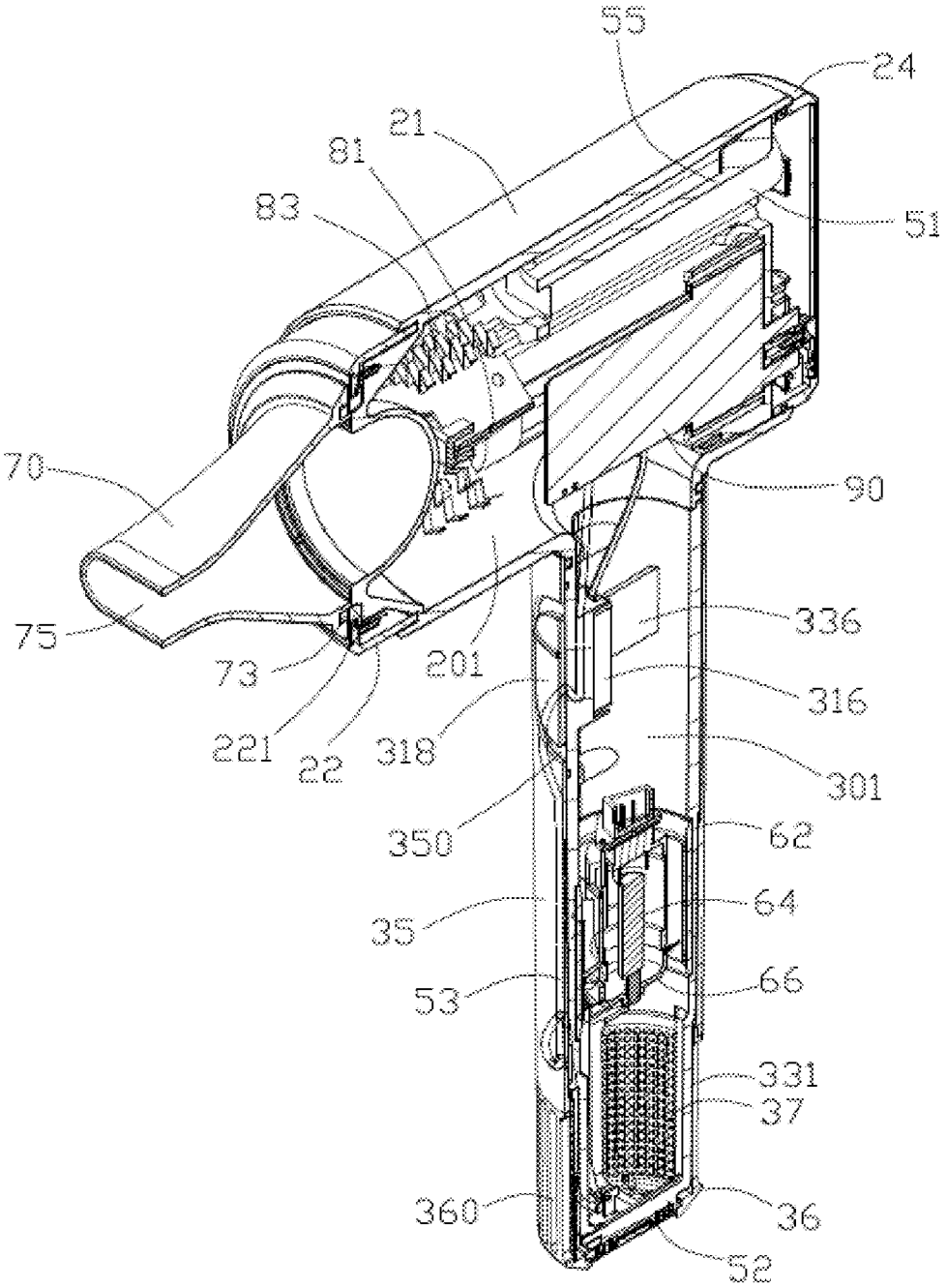
FIG. 21 is a perspective cross-sectional view of the wireless blow dryer illustrated in FIG. 3.

As illustrated in FIG. 15 to FIG. 16, the heating module assembly 80 is arranged at one end of the energy storage assembly 50. Specifically, the heating module assembly 80 includes a heating module bracket 81 connected to the energy storage assembly 50, and a heating module 83 wrapped on the heating module bracket 81. The heating module 83 is electrically coupled to the main control board 90. In this embodiment, the heating module 83 is heating wires electrically coupled to the main control board 90. When the blow dryer 100 is in a hot air mode, the main control board 90 controls the energy storage assembly 50 to supply power to the heating module 83, so that the heating module 83 generates heat. Specifically, the heating module bracket 81 is fixed to an end of the cell bracket 55 away from the connecting plate 550. As illustrated in FIG. 19 to FIG. 20, in this embodiment, the heating module bracket 81 includes two supporting plates 812 that are staggeredly connected and a positioning block 815. Each supporting plate 812 is provided with a plurality of bayonets 814 on its two opposite ends respectively. The plurality of bayonets 814 are arranged along the sides of the supporting plate 812. The positioning block 815 is provided with staggered clamping slots 817 on its one side facing the heating module bracket 81. The positioning block 815 is provided with connecting holes 818 on its two opposite ends respectively.

When assembling the heating module assembly 80 to the cell bracket 55, as illustrated in FIG. 15 to FIG. 17 and FIG. 19 to FIG. 20, the heating module 83 is wrapped on the heating module bracket 81, that is, the heating module 83 is clamped into the bayonets 814 of the supporting plate 812. One end of the heating module bracket 81 away from the heating module 83 is connected to the cell bracket 55. Specifically, the supporting plates 812 are clamped into the clamping slots 5562 of the cell bracket 55. The positioning block 815 is connected to the connecting member 556 of the cell bracket 55. Specifically, one end of the supporting plate 812 away from the cell bracket 55 is clamped into the clamping slot 817 of the positioning block 815, and the two locking members are respectively inserted into the connecting holes 818 on the positioning block 815, and then locked to the connecting member 556 of the cell bracket 55, so that the heating module bracket 81 is fixedly connected to the cell bracket 55.

Please refer to FIG. 6 to FIG. 11 and FIG. 21 together, when assembling the blow dryer 100, a combination of the energy storage assembly 50 and the heating module assembly 80 is placed in the air outlet channel 201 of the main housing 21, so that the plurality of supporting columns 551 on the energy storage assembly 50 and the plurality of supporting columns 214 on the main housing 21 are connected one by one. A plurality of locking members such as screws are respectively inserted into the connecting holes 2140 on the supporting columns 214 and the corresponding fixing hole 5510 on the energy storage assembly 50, and then locked in the corresponding fixing holes 5510, so that the energy storage assembly 50 and the heating module assembly 80 are fixed to the main housing 21. At this time, the heating module assembly 80 is located in the air outlet channel 201 and is close to the air outlet 211 of the main housing 21. The energy storage assembly 50 and the main control board 90 are located at one end of the air outlet channel 201 away from the air outlet 211, and one end of the energy storage assembly 50 and one end of the main control board 90 that are close to the heating module assembly 80 face the air inlet channel 301. The axial direction of each rechargeable battery 51 intersects with the extending direction of the air inlet channel 301. Preferably, the axial direction of the rechargeable battery 51 is perpendicular to the extending direction of the air inlet channel 301. A width direction of the main control board 90 is parallel to the extension direction of the air inlet channel 301, and a length direction of the main control board 90 is parallel to the extension direction of the air outlet channel 201. In this way, part of the airflow entering the air outlet channel 201 from the air inlet channel 301 passes through gaps among the rechargeable batteries 51 and an outer surface of the main control board 90, then passes through the heating module assembly 80, and finally is discharged through the air outlet 211. Another part of the airflow directly passes through the heating module assembly 80 from the air inlet channel 301 and is discharged from the air outlet 211. It is understandable that, during the use of the blow dryer 100, since part of cool airflow flowing from the air inlet channel 301 to the air outlet channel 201 passes through the rechargeable batteries 51 and the main control board 90, then passes through the heating module assembly 80, and finally is discharged through the air outlet 211. Therefore, the heat generated by the rechargeable batteries 51 and the main control board 90 during operation is dissipated in time by the cool airflow flowing from the air inlet channel 301 to the air outlet channel 201, which makes the blow dryer 100 work more stable and prevents the rechargeable batteries 51 and the main control board 90 from being damaged due to excessive temperature, thereby improving the service life of the blow dryer 100.

The sealing ring 247 is sleeved in the positioning slot 246 on the rear cover 24, and the rear cover 24 is mounted to the rear end of the main housing 21 until the flange 243 on the rear cover 24 abuts the positioning strips 216 on the main housing 21. Then, a plurality of locking members are inserted into the counterbore holes 244 on the rear cover 24 and locked in the fixing hole 5571 of the corresponding fixing column 557 on the cell bracket 55, so that the rear cover 24 is fixed to the main housing 21 through the cell bracket 55, thereby firmly fixing the energy storage assembly 50 and the heating module assembly 80 into the main housing 21.

The front housing 22 is mounted at the front end of the main housing 21. Specifically, the front housing 22 is sleeved on the snapping ring 212 of the main housing 21, and a plurality of locking members such as screws pass through the mounting holes defined on the front housing 22 and the corresponding locking holes defined on the connecting columns 213, and then are locked in corresponding locking holes of the connecting columns 213, so as to fixedly connect the front housing 22 to the main housing 21.

The fan assembly 60 is mounted into the handle 30. Specifically, part of the structure of the air inlet cylinder 62 of the fan assembly 60 is received in the positioning groove 312 of the handle body 31, and then the handle cover 33 is buckled onto the handle body 31 to make the other part of the structure of the air inlet cylinder 62 be received in the positioning groove 332 of the handle cover 33. The clamping blocks 3310 of the tail frame 331 are respectively clamped into the corresponding clamping holes 3110 on the tail frame 311. A plurality of locking members such as screws are respectively inserted into the plurality of through holes 334 defined on the handle cover 33 and the corresponding connecting holes 314 defined on the handle body 31, and then locked in the corresponding connecting holes 314, so that the handle body 31 and the handle cover 33 are fixed together, and the fan assembly 60 is clamped between the handle body 31 and the handle cover 33. At this time, the rotation axis of the fan blade 66 of the fan assembly 60 is collinear with the axis line of the handle 30. That is, the center line of the air inlet channel 301 is collinear with the rotation axis of the fan blade 66, and the abutting piece 336 of the handle cover 33 abuts the first control switch 3161 and the second control switch 3163, respectively. The wires 53 are received in the wire slot 303 of the handle body 31, and the sleeve 35 is sleeved on the handle body 31 and the handle cover 33 until the guiding groove 350 defined on the sleeve 35 faces the sliding slot 319 defined on the handle body 31. The guiding hooks 3182 of the two toggle buttons 318 are respectively inserted into the corresponding sliding slots 319 and connected to the first control switch 3161 and the second control switch 3163. The charging connector 52 is received in the mounting hole 364 of the tail cover 36, and the filter mesh 37 is attached to the inner side surface of the tail cover 36. Then the tail cover 36 is connected to the tail end of the sleeve 35. Specifically, the tail cover 36 is sleeved on the tail frames 311 and 331, and the camping strip 362 of the tail cover 36 is clamped in the clamping slot 352 of the sleeve 35. At this time, the sleeve 35 is exposed outside the air inlets 315 and 335, and the air inlet hole 360 on the tail cover 36, the through hole on the filter mesh 37 and the air inlets 315 and 335 are in communication with each other.

Alternatively, the heating module assembly 80 further includes a temperature probe (not illustrated) electrically coupled to the main control board 90. The temperature probe is adjacent to the heating module 83 to measure the temperature of the hot airflow generated by the blow dryer 100. That is, the temperature probe is configured to measure the temperature of the hot airflow near the heating module 83. When the main control board 90 detects, through the temperature probe, that the temperature of the hot airflow is higher than a preset temperature value, the main control board 90 controls the heating module 83 to stop generating heat and/or the motor 64 to stop rotating. In this embodiment, the main control board 90 sets the preset temperature value as 80 degrees. When the temperature detected by the main control board 90 is higher than 80 degrees, the main control board 90 controls the rechargeable battery 51 to stop supplying power to the heating module 83, and at the same time, it also controls the rechargeable batteries 51 to stop supplying power to the motor 64, so that the heating module 83 stops generating heat and the motor 64 stops rotating. Alternatively, when the temperature value detected by the main control board 90 is higher than 80 degrees, the main control board 90 first controls the rechargeable batteries 51 to stop supplying power to the heating module 83 to stop the heating module 83 from generating heat, and then control the rechargeable batteries 51 to stop supplying power to the motor 64 to stop the motor 64 from rotating.

Figure 24:
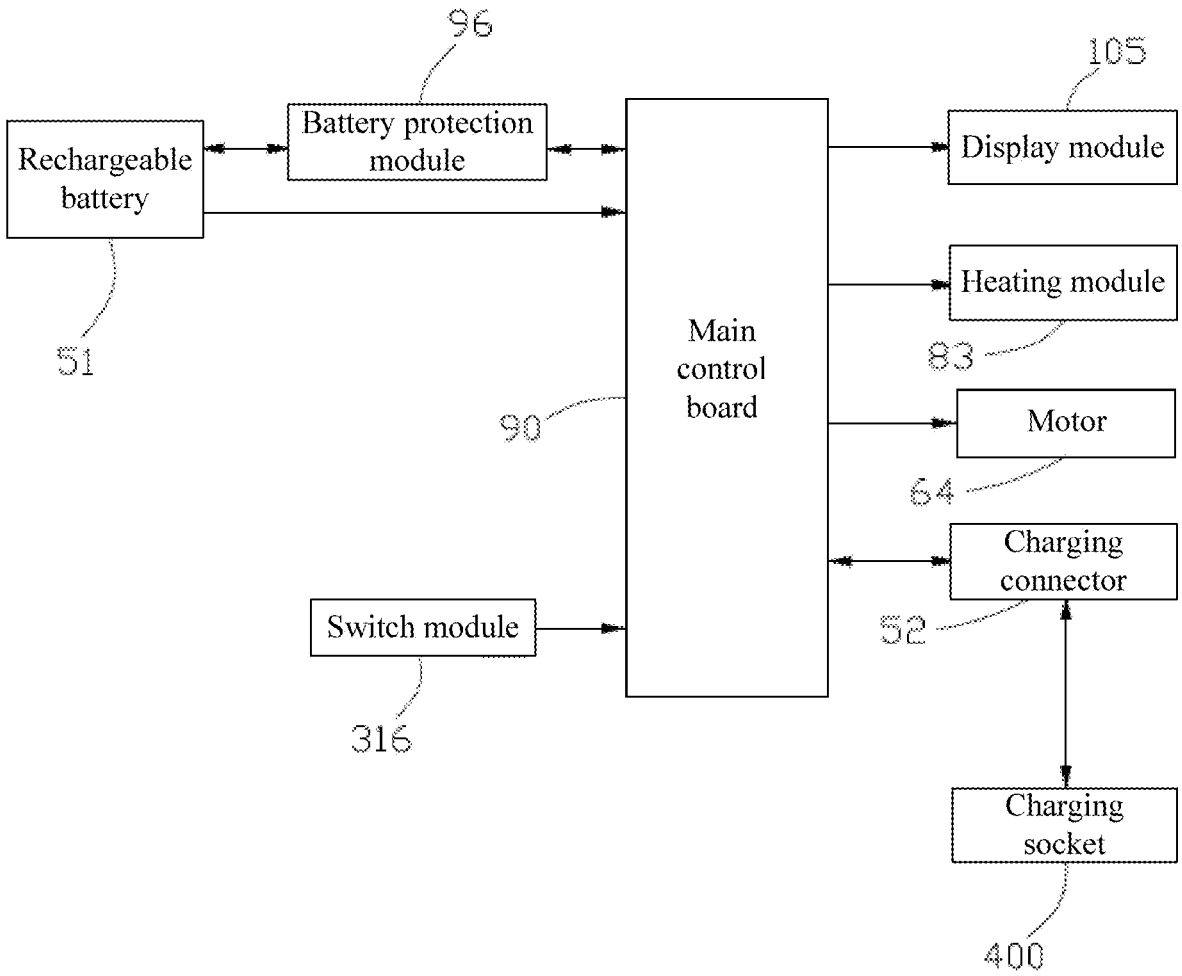
FIG. 24 is a circuit block diagram of the wireless blow dryer of the present disclosure according to an embodiment of the present disclosure.

Alternatively, the blow dryer 100 further includes a display module 105 (as illustrated in FIG. 24) electrically coupled to the main control board 90. The display module 105 is configured to display the power and charging status of the rechargeable batteries 51, so as to facilitate the user to observe the charging status of the blow dryer 100 in time. It is understandable that, the display module 105 can also be configured to display a working status of the blow dryer 100, and the user can know the working status of the blow dryer 100 in time by observing the display module 105. The display module 105 may be an LED lamp, a digital tube, or a display screen, etc., provided on the housing of the blow dryer 100.

Figure 1:
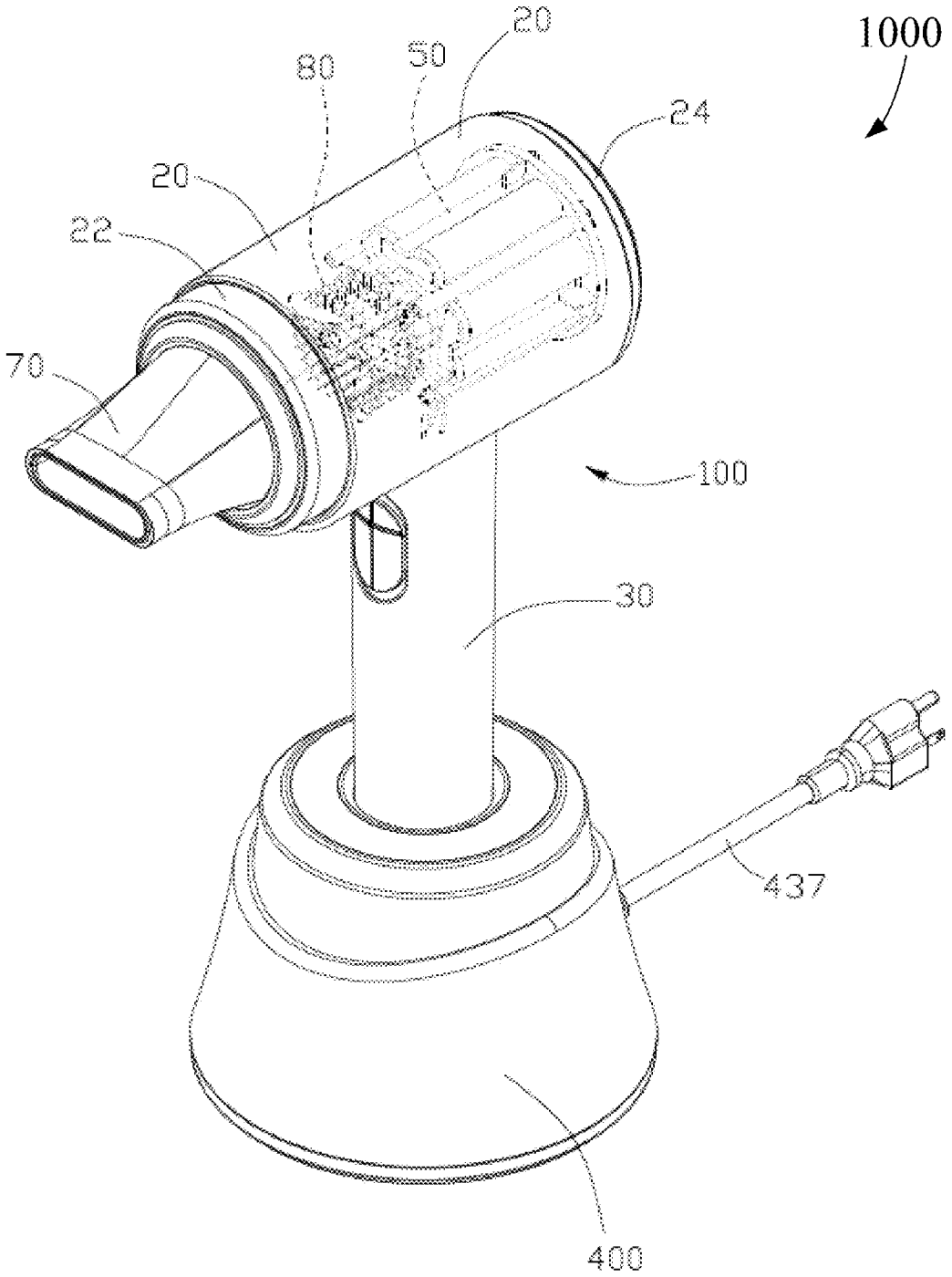
FIG. 1 is a schematic diagram of a three-dimensional structure of a wireless blow dryer system according to an embodiment of the present disclosure, in which a wireless blow dryer and a charging socket included in the wireless blow dryer system are in a connected state.
Figure 2:
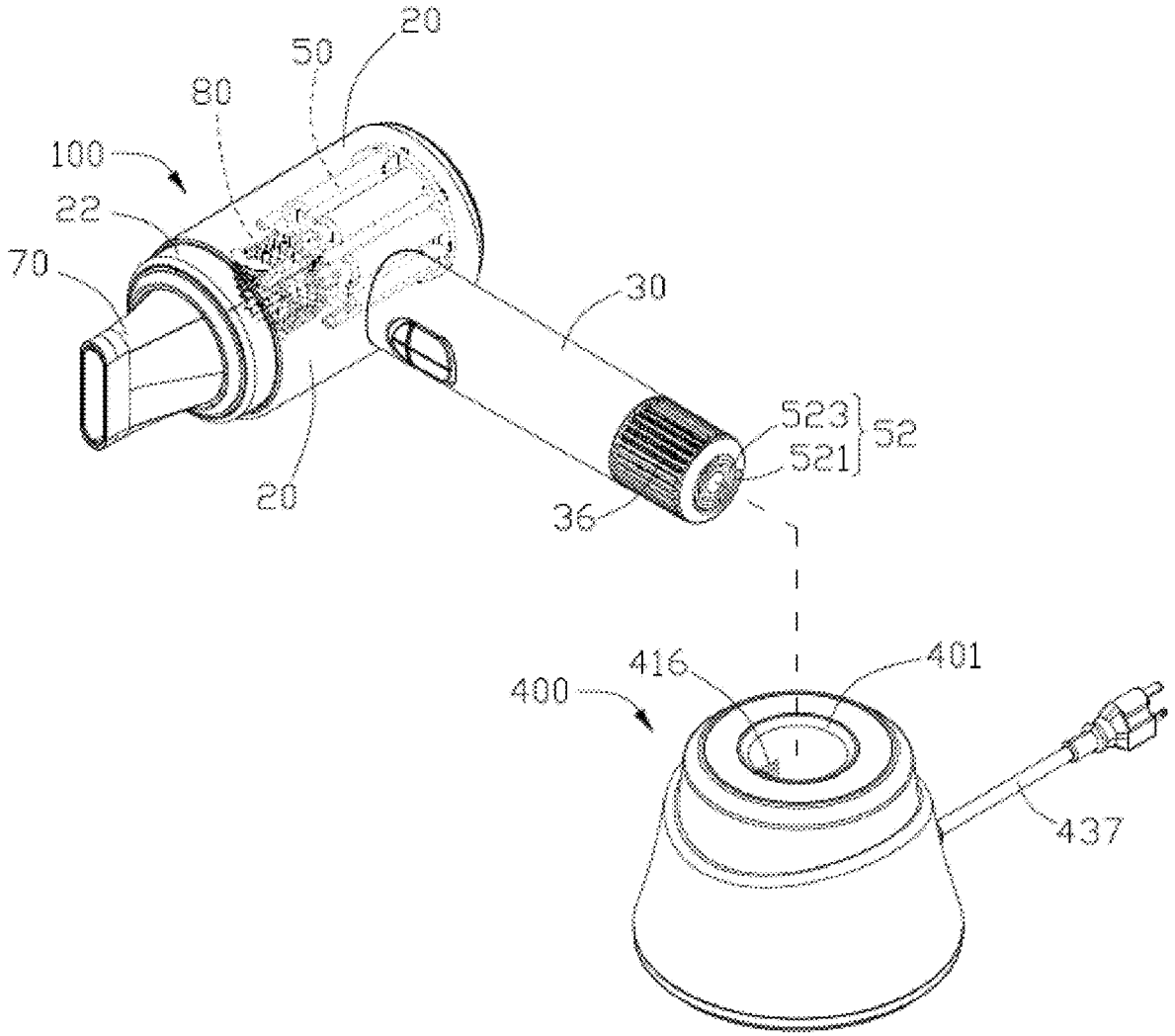
FIG. 2 is a schematic diagram of the three-dimensional structure of the wireless blow dryer and the charging socket that are in a separated state.
Figure 3:
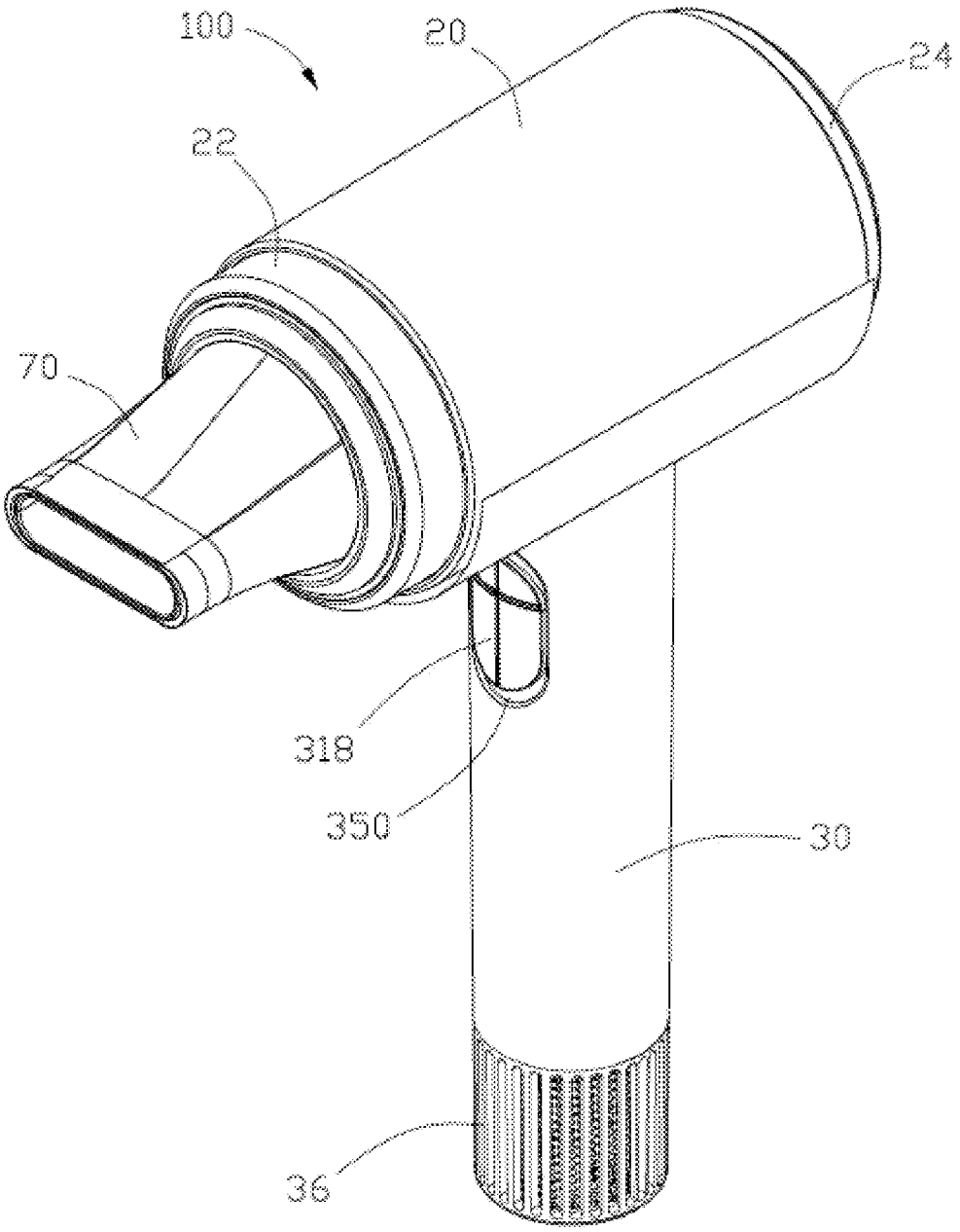
FIG. 3 is a schematic diagram of a three-dimensional structure of the wireless blow dryer according to an embodiment of the present disclosure.
Figure 22:
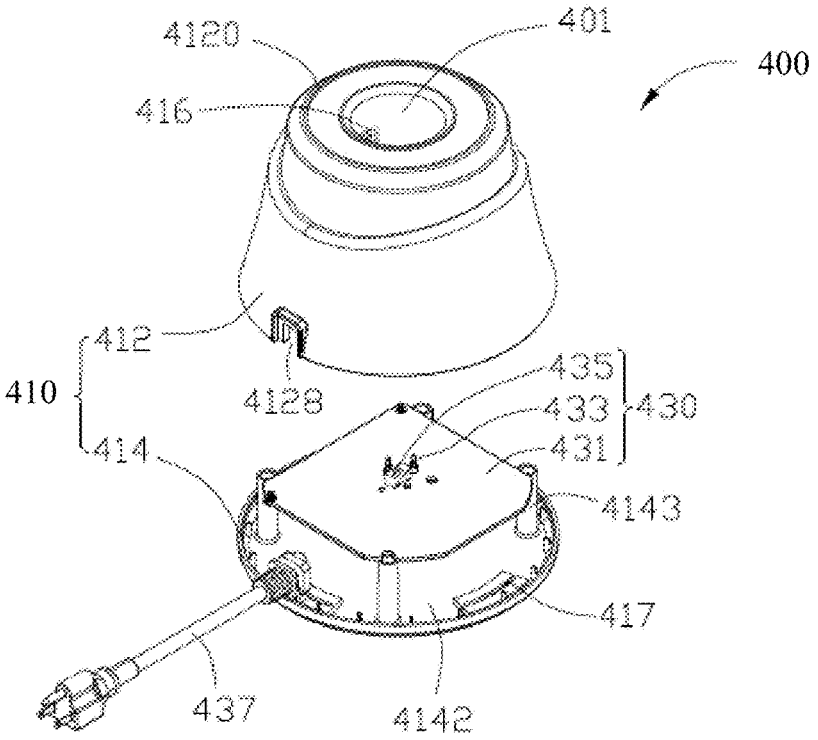
FIG. 22 is an exploded schematic diagram of the three-dimensional structure of the charging socket illustrated in FIG. 2.
Figure 23:
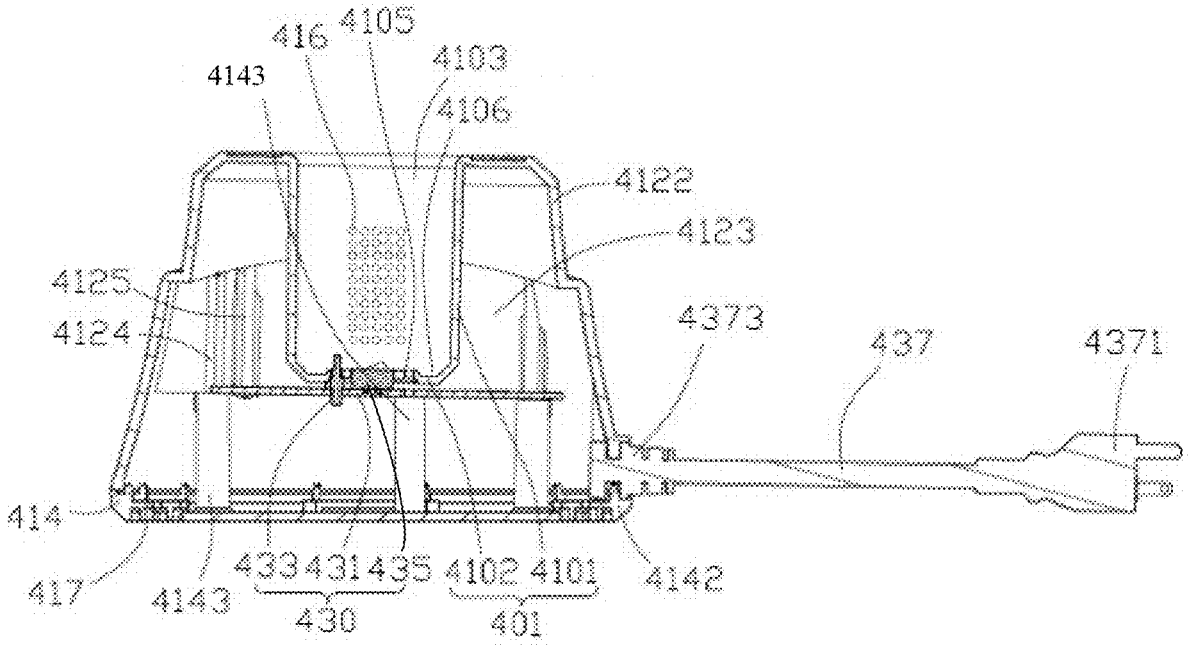
FIG. 23 is a schematic cross-sectional view of the charging socket illustrated in FIG. 2.

As illustrated in FIG. 2 and FIG. 22 to FIG. 23, the charging socket 400 includes an inserting portion 401 and a charging terminal 433 provided in the inserting portion 401. Since the charging connector 52 of the blow dryer 100 is electrically coupled to the main control board 90, when the handle 30 is inserted into the inserting portion 401, the charging connector 52 is electrically coupled to the charging terminal 433, and the main control board 90 uses the electric energy provided by the charging socket 400 to charge the rechargeable batteries 51 of the blow dryer 100.

Specifically, the charging socket 400 includes a hollow base 410 and a charging assembly 430 arranged in an inner cavity of the base 410. A top of the base 410 is concave toward an inner of the base 410 to form the inserting portion 401. The charging assembly 430 includes a circuit board 431 and the charging terminal 433 that is electrically coupled to the circuit board 431. Preferably, the charging terminal 433 is arranged on the circuit board 431. The circuit board 431 is further provided with a transformer (not illustrated), which can convert alternating current into direct current to power the blow dryer 100 for charging.

The base 410 includes an upper housing 412 and a lower housing 414. The upper housing 412 and the lower housing 414 can be connected together by buckling. The upper housing 412 includes a top plate 4120 and a side wall 4122 surrounding the top plate 4120. A middle portion of the top plate 4120 is concave toward an inner cavity of the upper housing 412 to form the inserting portion 401. In this embodiment, the upper housing 412 is substantially in the shape of a truncated cone, that is, the top plate 4120 is a circular ring plate. The side wall 4122 surrounds an outer periphery of the top plate 4120, and the top plate 4120 cooperates with the side wall 4122 to define a receiving space 4123. The charging assembly 430 is received in the receiving space 4123, and the inserting portion 401 extends from the top plate 4120 into the receiving space 4123. Preferably, a radial dimension of the receiving space 4123 gradually increases from an upper edge of the side wall 4122 close to the top plate 4120 to a bottom edge of the side wall 4122 away from the top plate 4120. That is, an outer circumference of the top plate 4120 is smaller than that of the bottom edge of the side wall 4122 away from the top plate 4120, so as to make the placement of the base 410 more stable.

As illustrated in FIG. 23, the inserting portion 401 includes an inserting cylinder 4101 connected to the upper housing 412 of the charging socket 400 and a connecting plate 4102 provided at the bottom of the inserting cylinder 4101. The inserting cylinder 4101 cooperates with the connecting plate 4102 to define an inserting space 4103. The handle 30 can be received in the inserting space 4103. The connecting plate 4102 is provided with a diversion hole (not illustrated), which communicates an outside of the charging socket 400. The diversion hole is configured to discharge liquid, such as water, erroneously flowed into the inserting cylinder 4101 to the outside of the charging socket 400, so as to play a role of dredging, and avoid a short circuit, damage, or other abnormal conditions to the blow dryer 100 caused by the liquid contacting with the charging terminal 433 and/or the charging connector 52.

In this embodiment, the inserting cylinder 4101 is a circular cylinder, and the inserting cylinder 4101 extends from the middle portion of the top plate 4120 along an axial direction of the base 410 toward the receiving space 4123. The inserting space 4103 of the inserting cylinder 4101 is a circular hole, and an inner diameter of the inserting cylinder 4101 is slightly greater than a diameter of the free end of the handle 30, so as to facilitate the insertion or removal of the free end of the handle 30.

In other embodiments, the inserting space 4103 of the inserting cylinder 4101 may also be a rectangular hole, an elliptical hole, a polygonal hole, etc. Correspondingly, the free end of the handle 30 is constructed as a rectangular column, an elliptical column, or a polygonal column, so as to facilitate the insertion of the free end of the handle 30 into the inserting space 4103, so that the charging connector 52 on the handle 30 and the charging terminal 433 of the charging socket 400 are kept in contact.

The connecting plate 4102 is provided with a boss 4105 protruded from the middle portion of the connecting plate 4102 toward the inserting space 4103. The charging terminal 433 extends into the inserting space 4103 after passing through the boss 4105. Specifically, the middle portion of a surface of the connecting plate 4102 facing the inserting space 4103 protrudes toward the inserting space 4103 to form the boss 4105. A surface of the boss 4105 facing the inserting space 4103 is closer to the top plate 4120 than a surface of the connecting plate 4102 facing the inserting space 4103. The boss 4105 is provided with a plurality of positioning holes (not illustrated), and a plurality of charging terminals 433 are respectively arranged in the plurality of positioning holes, that is, the charging terminals 433 passes through the positioning holes on the boss 4105 and are exposed in the inserting space 4103.

The connecting plate 4102 defines a diversion groove 4106 around the boss 4105, that is, the diversion groove 4106 is connected between the side wall of the boss 4105 and the connecting plate 4102. The diversion hole is defined on the diversion groove 4106. In this embodiment, the diversion hole communicates with the outside of the base 410 through a diversion tube. Specifically, the liquid in the diversion groove 4106 is discharged to the outside of the base 410 through the diversion hole and the diversion tube.

The upper housing 412 is provided with a plurality of positioning columns 4124 and a plurality of connecting columns 4125 inside the upper housing 412. The several positioning columns 4124 and the several connecting columns 4125 are configured to position the circuit board 431 to the inner cavity of the base 410. The lower housing 414 includes a base plate 4142 that can be buckled to a bottom edge of the upper housing 412. The base plate 4142 is provided, on its one surface facing the upper housing 412, with a plurality of hooks around the base plate 4142. The plurality of hooks are configured to be clamped to the bottom edge of the side wall 4122, so that the upper housing 412 and the lower housing 414 are fixedly connected together. The base plate 4142 is provided with a plurality of supporting columns 4143 on its one surface facing the upper housing 412. The plurality of supporting columns 4143 correspond to the plurality of positioning columns 4124 of the upper housing 412 one by one. Each supporting column 4143 is provided, on its top end surface, with a positioning hole (not illustrated) along its axial direction. When the upper housing 412 is buckled to the lower housing 414, each of the plurality of positioning columns 4124 is inserted into a corresponding positioning hole on the supporting columns 4143.

As illustrated in FIG. 2, the charging connector 52 includes a positive electrode 521 and a negative electrode 523, and the charging terminal 433 includes a positive terminal and a negative terminal. When the charging socket 400 charges the rechargeable batteries 51, the positive electrode 521 and the negative electrode 523 of the charging connector 52 are respectively coupled to the positive terminal and the negative terminal of the charging terminal 433 one by one.

As illustrated in FIG. 22 to FIG. 23, the charging socket 400 further includes an inductive switch 435 electrically coupled to the circuit board 431. When the charging connector 52 on the handle 30 is coupled to the charging terminal 433 on the charging socket 400, the inductive switch 435 is triggered to send a signal to the circuit board 431. The circuit board 431 receives the signal and controls the charging terminal 433 to output current, so as to charge the rechargeable batteries 51 of the blow dryer 100. The inductive switch 435 may be a touch switch, an infrared switch, or the like. When the inductive switch 435 is not triggered, the charging socket 400 is in a power-off state. The circuit board 431 is electrically coupled to an external power source through a power cable 437. Specifically, the power cable 437 is provided with a plug 4371 on its one end and a connecting portion 4373 on its other end. The connecting portion 4373 is electrically coupled to the circuit board 431. The upper housing 412 is further provided with a notch 4128 for positioning the power cable 437. Specifically, the upper housing 412 is provided with the notch 4128 at the bottom edge of the side wall 4122.

Preferably, the inductive switch 435 is provided on the circuit board 431. The plurality of charging terminals 433 are provided on the circuit board 431 around the inductive switch 435. Each charging terminal 433 has elasticity, so as to avoid damage to the charging connector 52 and the charging terminals 433 caused by the collision when the charging connector 52 is in contact with the charging terminals 433, thereby making the contact between the charging terminals 433 and the charging connector 52 more reliable.

Preferably, the circuit board 431 may further be provided with a battery protection circuit module (not illustrated), which is configured to effectively protect the rechargeable batteries 51 in the blow dryer 100, that is, provide over-charge protection, over-discharge protection, over-current protection, short-circuit protection, etc., for the rechargeable batteries 51, so as to ensure the safety and stability of the charging socket 400 during a working process.

Since the peripheral wall of the handle 30 is provided with the plurality of air inlet holes 360, when the blow dryer 100 is in use, external air enters the air duct 20 through the air inlet holes 360 and is discharged from the air outlet 211 of the blow dryer 100. As illustrated in FIG. 23, the upper housing 412 of the base 410 is provided with a plurality of air holes 416, and the lower housing 414 is provided with a plurality of air slots 417. Specifically, the plurality of air holes 416 are defined on the side wall of the inserting cylinder 4101 of the upper housing 412, and each air hole 416 communicates with the inserting space 4103 and the receiving space 4123. The plurality of air slots 417 are defined on the base plate 4142 of the lower housing 414, and the air slots 417 communicate with the receiving space 4123 and the outside of the base 410. Therefore, the air holes 416 communicate with the air slots 417, that is, the external air enters the receiving space 4123 through the air holes 417, and then enters the inserting space 4103 through the air holes 416. When the handle 30 is inserted into the inserting portion 401, the plurality of air slots 417 and the plurality of air holes 416 communicate with the plurality of air inlet holes 360. If the blow dryer 100 is activated during the charging process, the external air enters the receiving space 4123 through the air slots 417 on the lower housing 414, then enters the air inlet holes 360 on the handle 30 through the air holes 416, and then enters the air duct 20 from the air inlet holes 360, and is finally discharged from the air outlet 211 of the blow dryer 100, so as to prevent blow dryer 100 from being damaged when the blow dryer 100 is activated during the charging process but there is no air intake. Specifically, the inserting cylinder 4101 is provided with the plurality of air holes 416 at a position corresponding to the air inlet holes 360 of the handle 30, and the plurality of air slots 417 are provided around the base plate 4142. When the blow dryer 100 inserted into the inserting portion 401 is activated, the external air enters the air inlet holes 360 of the handle 30 through the air slots 417 on the base plate 4142 and the air holes 416 on the inserting cylinder 4101.

As illustrated in FIG. 24, the main control board 90 is electrically coupled to the rechargeable batteries 51, the display module 105, the heating module 83, the motor 64, and the charging connector 52. The rechargeable batteries 51 are electrically coupled to the main control board 90 through the battery protection module 96, and the switch module 316 is electrically coupled to the main control board 90. The charging terminal 433 of the charging socket 400 is electrically coupled to the main control board 90 through the charging connector 52. The battery protection module 96 is electrically coupled to the rechargeable batteries 51 and the main control board 90. The battery protection module 96 protects the rechargeable batteries 51 from over-charging and over-discharging. At the same time, the rechargeable batteries 51 are also electrically coupled to the main control board 90, and the main control board 90 detects the voltage of the rechargeable batteries 51, so as to protect the rechargeable batteries 51. Therefore, the blow dryer 100 has double protection for the rechargeable batteries 51.

Figure 25:
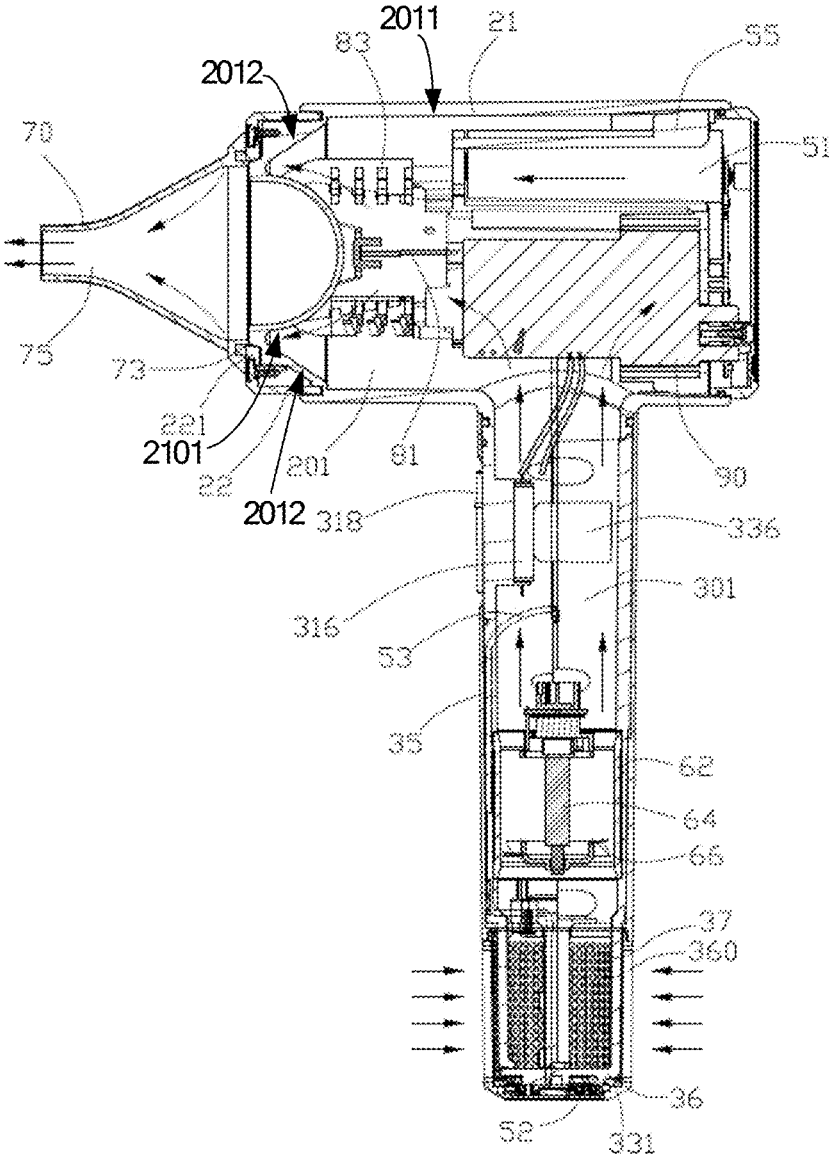
FIG. 25 is a schematic diagram of flow directions of internal airflow in the wireless blow dryer illustrated in FIG. 1 when the blow dryer is in use.

As illustrated in FIG. 25, when the blow dryer 100 is in use, the air nozzle 70 is mounted to the front end of the air duct 20, that is, the second adsorbing member 73 of the air nozzle 70 and the first adsorbing member 221 on the front housing 22 are positioned by the adsorption therebetween, and the air through hole 75 communicates with the air inlet hole 220 of the front housing 22. The toggle button 318 is operated to trigger the first control switch 3161, and then the first control switch 3161 sends a signal to the main control board 90. The main control board 90 receives the signal and controls the motor 64 to work to drive the fan blade 66 to rotate, so as to cause airflow to pass through the filter mesh 37 from the air inlet hole 360 of the tail cover 36, then enter the air inlet channel 301, and then exits through the air outlet channel 201, the air outlet 211, the air hole 220 and the air outlet through hole 75. When the wind volume of the blow dryer 100 needs to be adjusted, it is only need to slide the toggle button 318 to connect the first control switch 3161 to different gears, and then the main control board 90 controls the power of the motor 64 to adjust the rotation speed of the fan blade 66, so as to realize the adjustment of the wind volume. When hot air is needed, the toggle button 318 is operated to trigger the second control switch 3163, then the second control switch 3163 sends a signal to the main control board 90. The main control board 90 receives the signal and controls the heating module 83 to generate heat. When the airflow passes through the heating module 83, heat exchange occurs with it, so that the blow dryer 100 blows out hot air. In addition, the heating power of the heating module 83 can also be adjusted by operating the second control switch 3163, so as to meet users' needs for hot airflow of different temperatures.

In this embodiment, the switch module 316 is triggered by operating the toggle button 318, and the switch module 316 sends a signal to the main control board 90. The main control board 90 further controls the working mode and the wind speed of the blow dryer 100 according to the signal received from the switch module 316. The working mode includes a shutdown mode, a cool air mode, and a hot air mode. The wind speed includes a low speed, a medium speed, and a high speed. The shutdown mode means that the rechargeable batteries 51 in the blow dryer 100 stops supplying power to the main control board 90, the motor 64, the heating module 83, and the display module 105, so that the various components in the blow dryer 100 are in an inoperative state. The cool air mode means that the motor 64 of the blow dryer 100 works to drive the fan blade 66 to rotate to form an airflow, but the heating module 83 does not generate heat, that is, the airflow blown by the blow dryer 100 is natural wind. The hot air mode means that the motor 64 of the blow dryer 100 works to drive the fan blade 66 to rotate to form an airflow, at the same time, the main control board 90 controls the rechargeable batteries 51 to supply power to the heating module 83, and the heating module 83 also works to generate heat. When the air flows through the heating module 83, heat exchange occurs to form a hot airflow, that is, the airflow blown by the blow dryer 100 is hot air. The low speed, medium speed and high speed means that the main control board 90 controls the motor 64 to drive, with different powers, the fan blade 66 to rotate at different speed, so as to form airflows of three different wind speed levels: low speed, medium speed, and high speed. The wind volume at the high speed is the largest, followed by the wind volume at the medium speed, and wind volume at the low speed is the smallest.

When the blow dryer 100 is in a charging state, no matter what working mode the blow dryer 100 is currently in, the main control board 90 controls the rechargeable batteries 51 to stop supplying power to the heating module 83 and the motor 64, that is, the heating module 83 is powered off and the motor 64 stops rotating.

During the charging process of the blow dryer 100, the handle 30 of the blow dryer 100 can be taken out from the charging socket 400 at any time. When the blow dryer 100 is taken out from the charging socket 400, the blow dryer 100 exits the charging state and resumes the working mode before charging.

During use, the blow dryer 100 protects the rechargeable batteries 51 from over-discharge, that is, during the operation of the motor 64, if the main control board 90 detects that the voltage of any rechargeable batteries 51 is lower than a first preset voltage threshold value, the main control board 90 controls the heating module assembly 80 to stop generating heat and the motor 64 to stop rotating. Specifically, the first preset voltage threshold value set in the main control board 90 is 2.7V, when the main control board 90 detects that the voltage value of any rechargeable batteries 51 in the energy storage assembly 50 is lower than 2.7V, the main control board 90 controls the rechargeable batteries 51 to stop supplying power to the heating module 83 and the motor 64, so that the heating module 83 stops generating heat and the motor 64 stops rotating, and the display module 105 indicates the over-discharge state.

The over-charging protection when the blow dryer 100 is charging, that is, when the charging socket 400 is charging the rechargeable batteries 51, if the main control board 90 detects that the voltage value of any rechargeable batteries 51 is higher than a second preset voltage threshold value, the main control board 90 controls the rechargeable batteries 51 to stop charging. Specifically, if the second preset voltage threshold value set in the main control board 90 is 4.2V, when the charging socket 400 is charging the rechargeable batteries 51, if the main control board 90 detects that the voltage value of any rechargeable batteries 51 in the energy storage assembly 50 is higher than 4.2V, the main control board 90 controls the rechargeable batteries 51 to stop charging.

The differential pressure protection of the rechargeable batteries 51, that is, when the rechargeable batteries 51 are in a fully charged state, if the main control board 90 detects that the voltage value of any rechargeable batteries 51 is lower than a third preset voltage threshold value, the main control board 90 prohibits the charging and/or discharging of the rechargeable batteries 51. Specifically, the third preset voltage threshold value set in the main control board 90 is 3.73V, when the rechargeable batteries 51 are in a fully charged state, if the main control board 90 detects that the voltage value of any rechargeable batteries 51 is lower than 3.73V, the main control board 90 determines that the voltage difference among the single rechargeable batteries 51 is too great, the main control board 90 prohibits the charging and discharging of the rechargeable batteries 51 to lock the fault. Even if the main control board 90 is powered on again, it will still enter this protection mode.

The over-use protection of the rechargeable batteries 51, that is, when the main control board 90 detects that the rechargeable batteries 51 have been charged more than a preset number of times threshold, the main control board 90 prohibits the charging and/or discharging of the rechargeable batteries 51. Specifically, the preset number of times threshold set by the main control board 90 is 1000 times. When the charging socket 400 is charging the rechargeable batteries 51, if the main control board 90 detects that the rechargeable batteries 51 have been charged more than 1000 times, the main control board 90 determines that the rechargeable batteries 51 have been overused, and prohibits the charging and discharging of the rechargeable batteries 51 to lock the fault. Even if the main control board 90 is powered on again, it will still enter this protection mode.

When the blow dryer 100 is in the hot air mode, if the main control board 90 detects that the voltage of any rechargeable batteries 51 is lower than a fourth preset voltage threshold value, the main control board 90 controls the heating module assembly 80 to stop generating heat, and the motor 64 continues to work. The hot air mode means that when the motor 64 is working, the heating module 83 also works and generates heat. Specifically, the fourth preset voltage threshold value set in the main control board 90 is 3.1V. When the blow dryer 100 is in the hot air mode, when the main control board 90 detects that the voltage value of any rechargeable batteries 51 is lower than 3.1V, the main control board 90 controls the heating module 83 to stop generating heat, and the motor 64 continues to work.

The above is the embodiments of the present disclosure. It should be noted that for those of ordinary skill in the art, several improvements and modifications can be made without departing from the principles of the embodiments of the present disclosure. These improvements and modifications are also considered as the protection scope of the present disclosure.

What is claimed is:

1. A blow dryer, comprising:

an air duct, arranging an air outlet channel and an air outlet in air communication with the air outlet channel; and a handle, coupled to the air duct;

wherein the air duct is provided with an air guiding element at a front end of the air outlet channel, the air guiding element is configured to guide airflow in the air outlet channel to an inside wall of the air outlet channel, so that the airflow is concentrated and discharged from the air duct through the air outlet, and wherein the air duct comprises a main housing and a front housing arranged at a front end of the main housing, the front housing defines an air hole corresponding to the air outlet, so that the air outlet is exposed to outside through the air hole, and the front housing is provided with a first adsorbing member on an end of the front housing away from the main housing, and the first adsorbing member surrounds the air hole.

2. The blow dryer of claim 1, wherein the air outlet is arranged around the air guiding element.

3. The blow dryer of claim 1, wherein the air guiding element is provided at a front end of the air duct and is concave toward a rear end of the air duct along an axial direction of the air duct in the air outlet channel.

4. The blow dryer of claim 3, wherein the air guiding element is a hemispherical structure.

5. The blow dryer of claim 1, wherein the inside wall of the air outlet channel is provided with a first air guiding surface at the front end of the air outlet channel, and the first air guiding surface obliquely extends inward in a radial direction of the air duct, toward the air guiding element.

6. The blow dryer of claim 5, wherein the first air guiding surface is annular in shape is annular in shape.

7. The blow dryer of claim 5, wherein the first air guiding surface comprises a first end relatively close to the air outlet and a second end relatively far from the air outlet, and a radial dimension of the air outlet channel gradually decreases from the first end to the second end of the air outlet channel.

8. The blow dryer of claim 5, wherein the air guiding element comprises a second air guiding surface coupled to the first air guiding surface, and the air outlet is arranged at connection between the first air guiding surface and the second air guiding surface.

9. The blow dryer of claim 1, wherein the main housing is provided with the air guiding element at the front end of the air outlet channel.

10. The blow dryer of claim 9, wherein the main housing is provided with a snapping ring protruding from the front end of the main housing along an axial direction of the main housing and around the air outlet, and the front housing is sleeved on the snapping ring.

11. The blow dryer of claim 10, wherein the air outlet is exposed relative to the front housing, and the air outlet comprises a plurality of air outlet holes provided at the front end of the main housing, the plurality of air outlet holes are arranged along a circumferential direction of the snapping ring for at least one circle and evenly spaced.

12. The blow dryer of claim 1, wherein the blow dryer further comprises an air nozzle, the air nozzle is provided with a second adsorbing member on an end of the air nozzle facing the front housing, and the first adsorbing member and the second adsorbing member are adsorbed to each other, so that the air nozzle is positioned on the air duct.

13. The blow dryer of claim 12, wherein the air nozzle housing defines an air outlet through hole along an axial direction of the air nozzle, the air outlet through hole is in air communication with the air hole and the air outlet, and the second adsorbing member is arranged around the air outlet through hole.

14. The blow dryer of claim 1, wherein the blow dryer is a wireless blow dryer, the blow dryer further comprises an energy storage assembly and a heating module assembly, the energy storage assembly and the heating module assembly are arranged in the air outlet channel, and the energy storage assembly is arranged at a side of the heating module assembly away from the air outlet.

15. The blow dryer of claim 14, wherein the energy storage assembly comprises an energy storage module and a cell bracket, and the energy storage module is positioned on the cell bracket.

16. The blow dryer of claim 15, wherein the blow dryer further comprises a main control board arranged in the air outlet channel, and the main control board is fixed on the cell bracket.

17. The blow dryer of claim 16, wherein the cell bracket comprises a connecting plate and a plurality of spaced supporting columns arranged on the connecting plate; the main control board is arranged between two adjacent supporting columns, and every two adjacent supporting columns of the remaining supporting columns is provided with a positioning ring, and the plurality of energy storage modules are respectively positioned in corresponding positioning rings.

18. The wireless blow dryer of claim 14, wherein the handle is provided with an air inlet channel in air communication with the air outlet channel, the blow dryer further comprises a fan assembly arranged in the air outlet channel, and when the fan assembly works, at least part of airflow flowing into the air outlet channel from the air inlet channel passes through the energy storage assembly and the heating module assembly in sequence, and then is discharged from the air outlet channel through the air outlet.

* * * * *